US011262168B1

(12) United States Patent
Morse

(10) Patent No.: US 11,262,168 B1
(45) Date of Patent: Mar. 1, 2022

(54) SIGHT SYSTEM INCORPORATING OPTICAL COMPONENTS SUCH AS LASERS AND/OR CAMERAS

(71) Applicant: Bradley Owen Morse, Stevens Point, WI (US)

(72) Inventor: Bradley Owen Morse, Stevens Point, WI (US)

( * ) Notice: Subject to any disclaimer, the term of this patent is extended or adjusted under 35 U.S.C. 154(b) by 0 days.

(21) Appl. No.: 16/375,728

(22) Filed: Apr. 4, 2019

Related U.S. Application Data

(60) Provisional application No. 62/653,454, filed on Apr. 5, 2018, provisional application No. 62/785,799, filed on Dec. 28, 2018.

(51) Int. Cl.

| | |
|---|---|
| ***F41G 3/06*** | (2006.01) |
| ***F41G 11/00*** | (2006.01) |
| ***F41J 5/10*** | (2006.01) |
| ***F41G 1/54*** | (2006.01) |

(52) U.S. Cl.
CPC ..... *F41G 11/003* (2013.01); *F41G 1/545* (2013.01); *F41G 3/065* (2013.01); *F41J 5/10* (2013.01)

(58) Field of Classification Search
None
See application file for complete search history.

(56) References Cited

U.S. PATENT DOCUMENTS

| | | | | |
|---|---|---|---|---|
| 5,481,819 | A | 1/1996 | Teetzel | |
| 6,366,344 | B1 | 4/2002 | Lach | |
| 7,726,061 | B1 | 6/2010 | Thummel | |
| 7,753,549 | B2 | 7/2010 | Solinsky et al. | |
| 8,104,186 | B2 | 1/2012 | Raschella et al. | |
| 8,769,858 | B2 | 7/2014 | Hancosky | |
| 8,844,189 | B2 | 9/2014 | Moore et al. | |
| 9,486,890 | B2 * | 11/2016 | Thompson | B23Q 17/2423 |
| 9,777,994 | B2 | 10/2017 | Hancosky | |
| 10,113,837 | B2 * | 10/2018 | Masarik | G02B 6/4206 |
| 2002/0046479 | A1 * | 4/2002 | Rogers | G01C 3/10 42/114 |
| 2012/0167441 | A1 * | 7/2012 | Holmberg | F16B 7/182 42/119 |
| 2013/0185982 | A1 | 7/2013 | Hilbourne et al. | |
| 2014/0360077 | A1 * | 12/2014 | Miller | F41C 27/00 42/84 |
| 2016/0138891 | A1 * | 5/2016 | Hancosky | F41G 1/545 42/114 |
| 2017/0146315 | A1 | 5/2017 | Bruhns | |

* cited by examiner

*Primary Examiner* — J. Woodrow Eldred
(74) *Attorney, Agent, or Firm* — Brannen Law Office, LLC

(57) ABSTRACT

The present invention relates to a sight system incorporating offset optical components. One embodiment is a sight system supporting multiple laser beams that are used simultaneously. As such, an assembly having two clamps is provided. Each clamp can hold a laser on opposite sides of a firearm barrel. The lasers can be diametrically opposed on the barrel wherein the lasers are in plane with a projectile axis. The lasers can project at the same time to bracket the location on the target of where the projectile hit impact. In another embodiment, the assembly, again with two clamps, is adapted for use with a bow, wherein the clamps support lasers that are in plane with the projectile axis. In another embodiment, the optical component is one or more cameras, wherein reticles can be displayed on a screen to bracket a target.

9 Claims, 27 Drawing Sheets

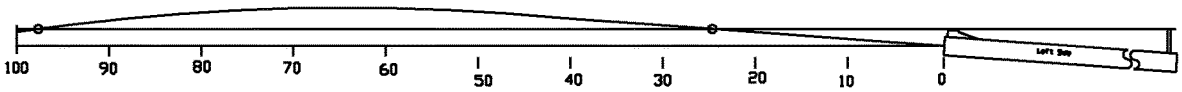
FIG. 1 - PRIOR ART
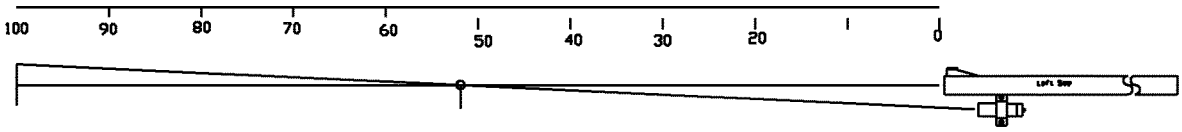
FIG. 2 - PRIOR ART
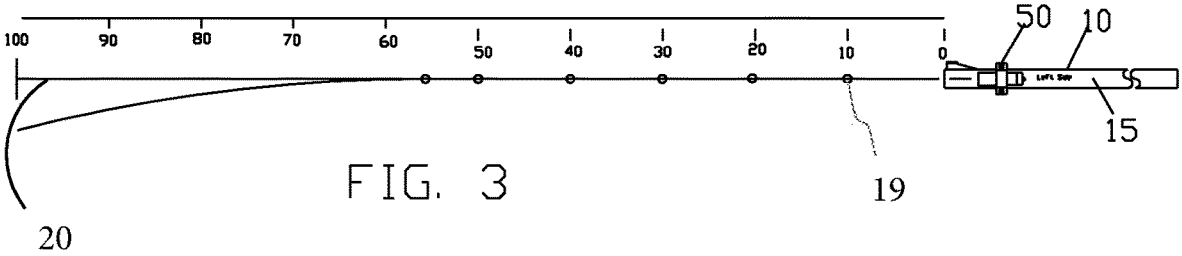
FIG. 3

SIGHT SYSTEM INCORPORATING OPTICAL COMPONENTS SUCH AS LASERS AND/OR CAMERAS

This United States utility patent application claims priority on and the benefit of provisional application 62/653,454 filed Apr. 5, 2018, and also claims priority on and the benefit of provisional application 62/785,799 filed Dec. 28, 2018, the entire contents of both being hereby incorporated herein by reference.

BACKGROUND OF THE INVENTION

1. Field of the Invention

The present invention relates to a sight system incorporating optical components, which can be a sight system utilizing multiple laser beams simultaneously or a sight system using one or more cameras.

2. Description of the Related Art

Optics, such as scopes and lasers, have greatly improved accuracy of firearms, bows and other items that project a projectile. Yet, optic sights are not without drawbacks.

Single optic systems have drawbacks that depend on where the optics are mounted relative to the projectile axis. Optics that are mounted to the top of a barrel, for example, are truly only accurate at two specific distances. Looking at FIG. 1, an example is illustrated showing how a conventional optic sight mounted on top of a barrel crosses the projectile path twice. This is disadvantageous as the target may not be located at either of the specific distances most often resulting in inaccurate placement of the optical focal point (e.g. a laser reflection point) on the target with respect to the true projectile axis. Before the first distance, the optical line will project above the projectile path. Between the distances, the optical line will project below the projectile path. After the second distance, the optical line will again project above the projectile path. A further drawback of top mounted optics is that their placement may interfere with the use of the traditional barrel sight.

There are also drawbacks when the optic is mounted to the bottom of the barrel. Looking at FIG. 2, it is seen that a bottom mounted laser optic is truly accurate at a single distance. If the target is before the specific distance, laser line is projected below the projectile path. After the specific distance, the laser line is projected above the projectile path.

Further, there are drawbacks with a side mounted optic, which is typically parallel to the projectile axis or convergent with the projectile axis. When, for example a laser optic is used, and the laser beam is convergent with the projectile axis, the drawback is that the laser beam is only accurate at the point of convergence. When the laser beam is parallel to the projectile axis, the drawback is that the laser is never fully accurate as it never accurately indicates the location of the projectile path. Further, there is no way to know how much to compensate for the offset.

When the laser beam is convergent with the projectile axis, the drawback is that the laser beam is only accurate at the point of convergence.

It is possible to use other types of optical components to sight a target. Yet, none to date have the unique advantages of the present invention.

Thus, there exists a need for a system with one or more optics that solves these and other problems.

SUMMARY OF THE INVENTION

The present invention relates to a sight system incorporating offset optical components. One embodiment is a sight system supporting multiple laser beams that are used simultaneously. As such, an assembly having two clamps is provided. Each clamp can hold a laser on opposite sides of a firearm barrel. The lasers can be diametrically opposed on the barrel wherein the lasers are in plane with a projectile axis. The lasers can project at the same time to bracket the location on the target of where the projectile hit impact. In another embodiment, the assembly, again with two clamps, is adapted for use with a bow, wherein the clamps support lasers that are in plane with the projectile axis. In another embodiment, the optical component is one or more cameras, wherein reticles can be displayed on a screen to bracket a target.

According to one advantage of one embodiment of the present invention, the laser beams are oriented in plane with the projection axis. Doing so overcomes the aforementioned issues with using a single laser beam as an aid. The present invention is generally accurate at any distance up until the point where the projectile drops out of the plane.

According to another advantage of the present invention, the device brackets the target between two laser beams. In this regard, it is fast and easy to determine the projectile axis, and hence the anticipated impact point, by visually determining the midpoint between the laser dots.

The present invention works the same with stationary targets and with targets in motion. Further, for objects in motion, it works when targets are moving either towards or away from the firearm, bow or other device.

The lasers bracket the target, but do not cover it up. In this regard, the point of impact of the projectile is not covered or concealed by the laser.

In one embodiment, the lasers can be slightly divergent. This has at least two advantages. First, due to laser degradation, the dots of the lasers have a tendency to get larger, or spread, over a traveled distance. If the laser beams were truly parallel, there would be a point where the enlarged dots would encroach into each-other and spread over the projectile path. Having slightly divergent beam axis eliminates this concern. Second, the laser dots get further apart as the distance between the user and the dots increase. This advantageously allows the user to readily observe the lasers bracketing the target at distance.

According to another advantage of the present invention, the plane can be rotated about the projection axis if necessary, in order for the dots to effectively bracket a target.

The present invention is useful in many environments, including use with juniors just learning. For example, the laser beams can provide a simple indication of the direction of the barrel. Also, the present invention can allow the user and a supervisor to evaluate a shot before it is taken.

According to a still further advantage of the present invention, the field of view of the user is increased dramatically when using the present invention. This is due to not needing to close one eye to use a traditional sight system. Instead, both eyes are open and the user can perceive their full field of vision up to the limits of their peripheral vision which can help ensure that the shot is safe.

According to a still further advantage yet of the present invention, it is a safety improvement. The user is alerted to possible shot obstructions in the event that both lasers are not visible on the target.

According to a still further advantage yet of the present invention, the device is usable regardless of the orientation of the user relative to the firearm, bow or another device. In this regard, the firearm, bow or other device is usable even when the user is in a safe and possibly even concealed position.

The present invention is useful with day and night lasers, which can be interchangeably supported by the present invention.

According to a still further advantage yet of the present invention, it does not interfere with the user's ability to use other sights. In this regard, the present invention can be used in conjunction with the other sights to gauge the effectiveness of the other sights.

According to one advantage of another embodiment of the present invention, the optical component can be a camera (digital or otherwise capable of capturing and sending data) that can be used to gather data and send it to a processor, wherein reticles can be displayed on a screen. In this regard, the sight system is easy to use.

According to another advantage of the present invention, one or two cameras can be used. When two cameras are used, they can be independently tuned so that the reticle of each camera properly bracket the impact point on the target.

According to an embodiment with a single camera, the processor adjusts the location of the reticles to be aligned with the barrel axis even though the focal point of the camera is below the location of the reticles.

According to a further advantage of the present invention, the camera or cameras can utilize visible (day), infrared (night) or other light energy forms for operation.

According to a still further advantage of the present invention, the display can either be wired or wirelessly connected to either an integrated display or a non-integrated display such as a hand-held device (smart phone or otherwise).

When an integrated display is used, the screen can advantageously be a reflex screen that projects the reticles over the target which is viewable through the screen.

According to a still further advantage yet of the present invention, input variables (ammo type and weight, firearm specifications, etc.) can be entered into the device via a menu screen or other input method or structure. Then, through use of a range finder, real-time projected drop can be determined, and the user can adjust the barrel axis accordingly to be on target (i.e. by placing the reticles on the target) compensating for the projected drop.

According to a still further advantage yet of the present invention, it is effective for both left and right handed, as well as for both left and right eye dominant users without modification.

Other advantages, benefits, and features of the present invention will become apparent to those skilled in the art upon reading the detailed description of the invention and studying the drawings.

BRIEF DESCRIPTION OF THE DRAWINGS

FIG. 1 is a view showing how a top mounted conventional optic (e.g. a single laser) is accurate only at two distances.

FIG. 2 is a view showing how a bottom mounted single laser is accurate only at a single distance.

FIG. 3 is a view showing how twin in plane lasers are always accurate until a projectile drops out of plane under force of gravity.

FIGS. 30 and 30A illustrate steps to sight-in the system with the range finder turned on.

DETAILED DESCRIPTION OF PREFERRED EMBODIMENTS

Figure 4:
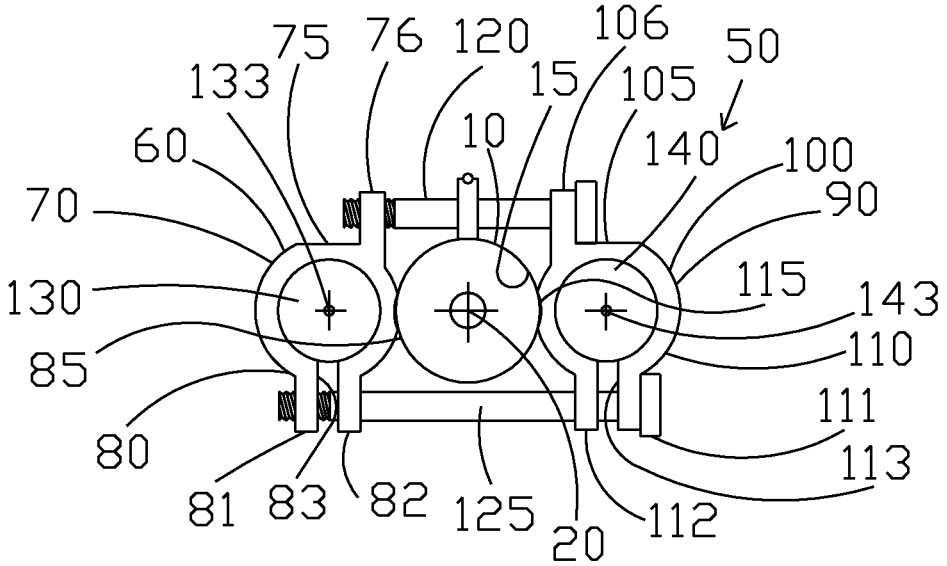
FIG. 4 is an end view showing an embodiment of the present invention mounted to the barrel of a firearm.
Figure 5:
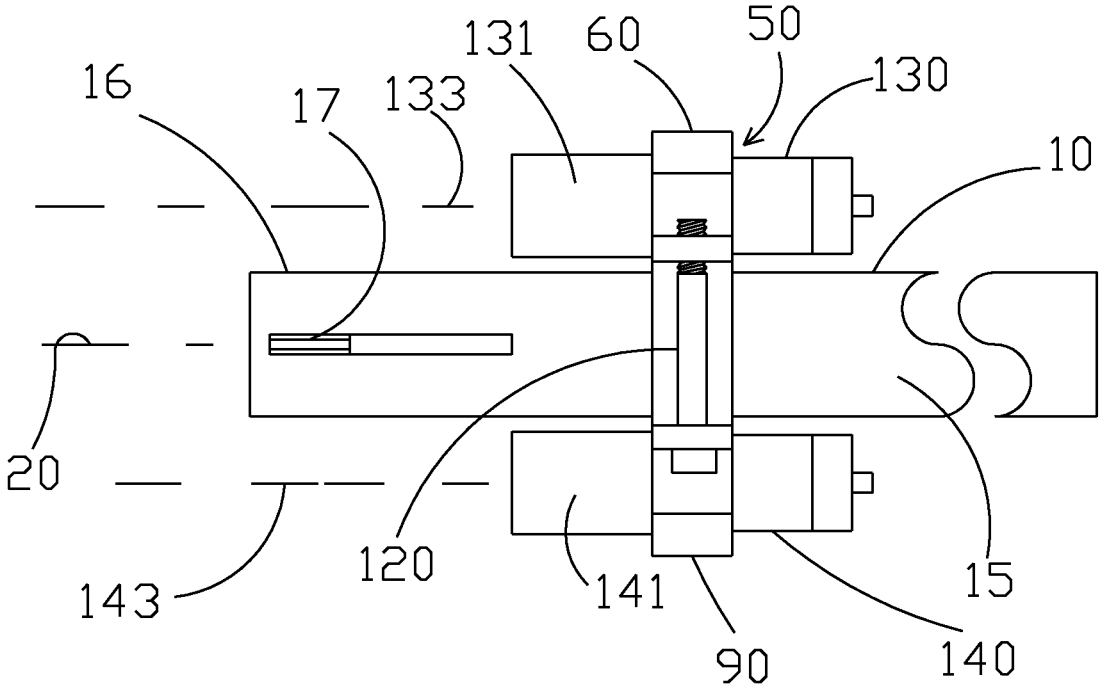
FIG. 5 is a top view of the embodiment illustrated in FIG. 4.
Figure 6:
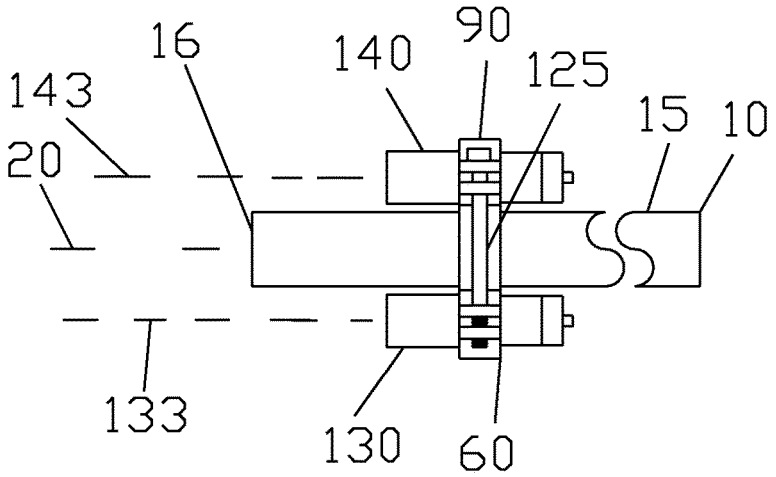
FIG. 6 is a bottom view of the embodiment illustrated in FIG. 4.
Figure 7:
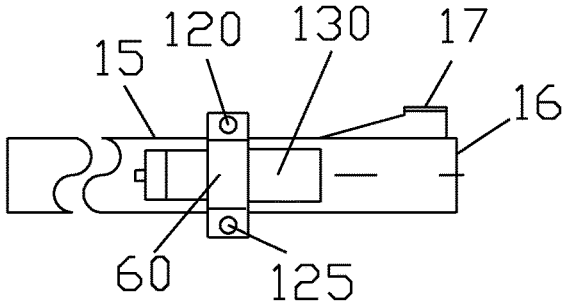
FIG. 7 is a side view of the embodiment illustrated in FIG. 4.
Figure 8:
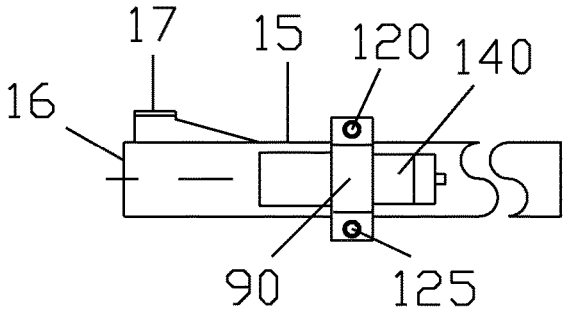
FIG. 8 is an opposite side view of the embodiment illustrated in FIG. 4.
Figure 9:
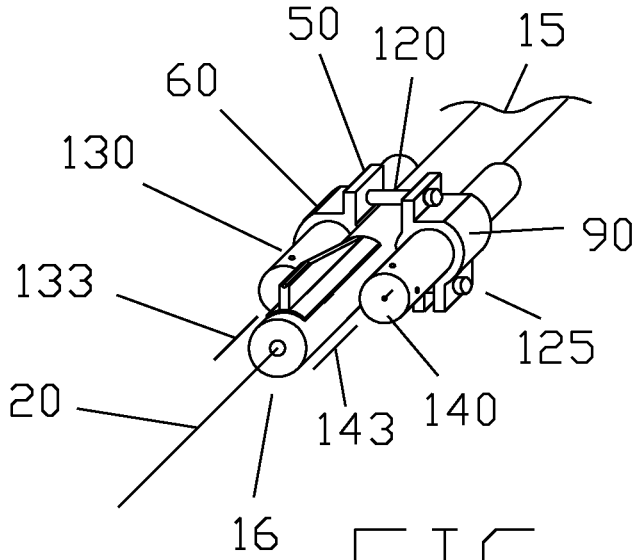
FIG. 9 is a perspective view of the embodiment illustrated in FIG. 4.
Figure 10:
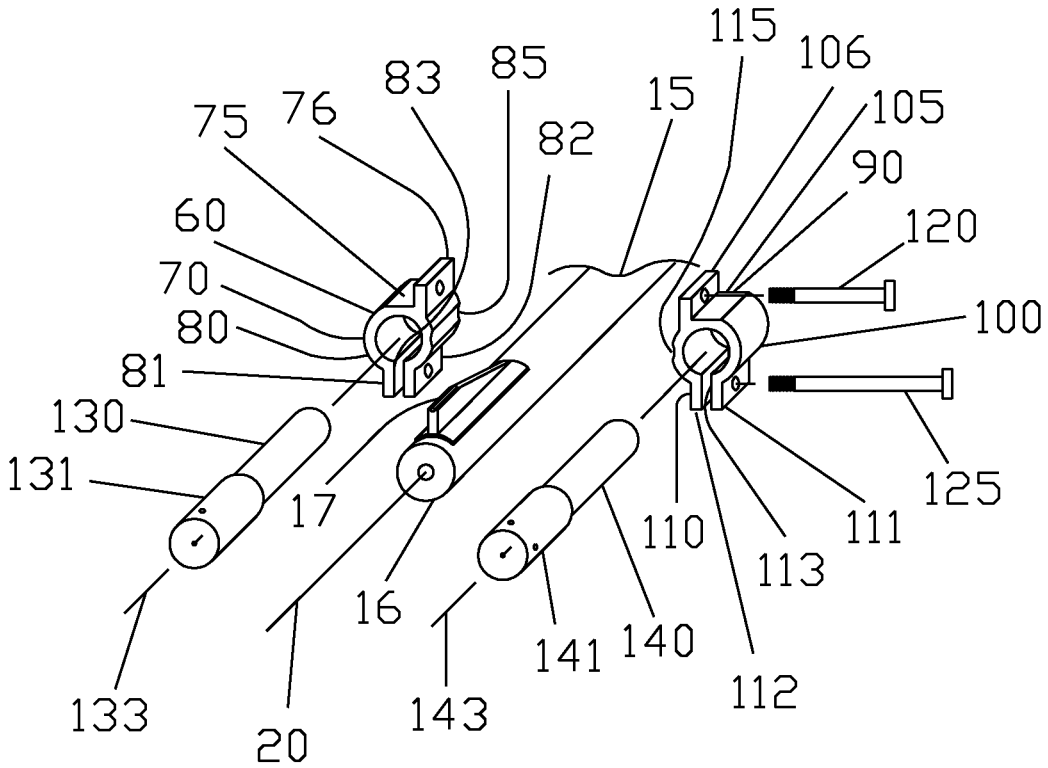
FIG. 10 is an exploded view of the embodiment illustrated in FIG. 4.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

A user 5 can use a firearm 10 with the present invention, as seen in FIGS. 3-13. The firearm 10 has a barrel 15 with an end 16 having a barrel sight 17. A projectile axis 20 is colinear with a longitudinal axis of the barrel 15 (barrel axis). The user 5 can project a projectile 19 along the projectile or projection axis 20 at a target 30. It is appreciated that while a traditional bullseye is illustrated, that the target can be any suitable target. Also, the firearm 10 is illustrated for exemplary purposes only, and the present invention is useful with any item that can project a projectile along a projectile axis.

A preferred embodiment of the device 50 of the present invention is illustrated in FIGS. 3-13. The device 50 has two clamps 60 and 90 that support lasers 130 and 140. Each of these parts and their use is described below.

Clamp 60 has a wall 70. The wall 70 has a top 75 with a tab 76. The tab has a threaded hole there through. The wall further has a bottom 80 with a first tab 81 and a second tab 82. The first tab 81 has a threaded hole there through. The second tab 82 has an unthreaded hole there through. The first tab hole and the second tab hole have respective hole axis that are linearly aligned. The wall has an opening 83 between tabs 81 and 82. The wall 70 defines a generally circular interior profile, wherein the size of the interior is adjustable based on the location of tab 81 relative to tab 82. An indentation 85 is provided on the exterior of the wall 70 on one side preferably midway between the top 75 and bottom 80 of the wall. Tab 76 is preferably offset from the center of the top 75 towards the side of the wall containing the indentation 85.

Clamp 90 has a wall 100. The wall 100 has a top 105 with a tab 106. The tab has an unthreaded hole there through. The wall further has a bottom 110 with a first tab 111 and a second tab 112. The first tab 111 and second tab 112 both have an unthreaded hole there through. The first tab hole and the second tab hole have respective hole axis that are linearly aligned. The wall has an opening 113 between tabs 111 and 112. The wall 100 defines a generally circular interior profile, wherein the size of the interior is adjustable based on the location of tab 111 relative to tab 112. An indentation 115 is provided on the exterior of the wall 100 on one side preferably midway between the top 105 and bottom 110 of the wall. Tab 106 is preferably offset from the center of the top 105 towards the side of the wall containing the indentation 115.

Looking specifically at FIG. 4, it is seen that clamps 60 and 90 have end profiles that are mirror images of each other. The clamps 60 and 90 can be diametrically placed on a firearm barrel 15. It is appreciated that while the clamps are shown horizontally on the firearm, that any diametric orientation can be used. When the clamps are in place, the respective hole axis of the holes in tabs 76 and 106 are linearly aligned. Also, the respective hole axis of the holes in tabs 81, 82, 111 and 112 are linearly aligned. A bolt 121 having a threaded end can be inserted through tab 106 and can be threadably received through the hole in tab 76. A bolt 125 can be inserted through the holes in tabs 112, 111 and 82 and be threadably received through hole 81.

A laser 130 with a body 131 that can project or shine a beam 132 along a beam axis 133 is provided. A laser 140 with a body 141 that can project or shine a beam 142 along a beam axis 143 is also provided.

Turning the bolts into the respective threaded holes provided a compressive force to hold the lasers 130 and 140 in place with respect to the clamps 60 and 90, and also provides a compressive force of the clamps 60 and 90 onto the barrel 15.

With the lasers 130 and 140 securely held in place within the respective clamps 60 and 90, it is understood that each laser can be tuned so that the respective beam axis 133 and 143 are accurate as intended. This is preferably accomplished internally within the lasers 130 and 140 after they are secured in the device. The beam axis 133 and 143 are planar with the projectile axis 20. Stated another way, a single line can intersect the projectile axis 20, the beam axis 133 and the beam axis 143. The beam axis 133 and beam axis 143 are preferably oriented slightly divergent from each other and from the projectile axis 20 while remaining planar therewith.

Figure 12:
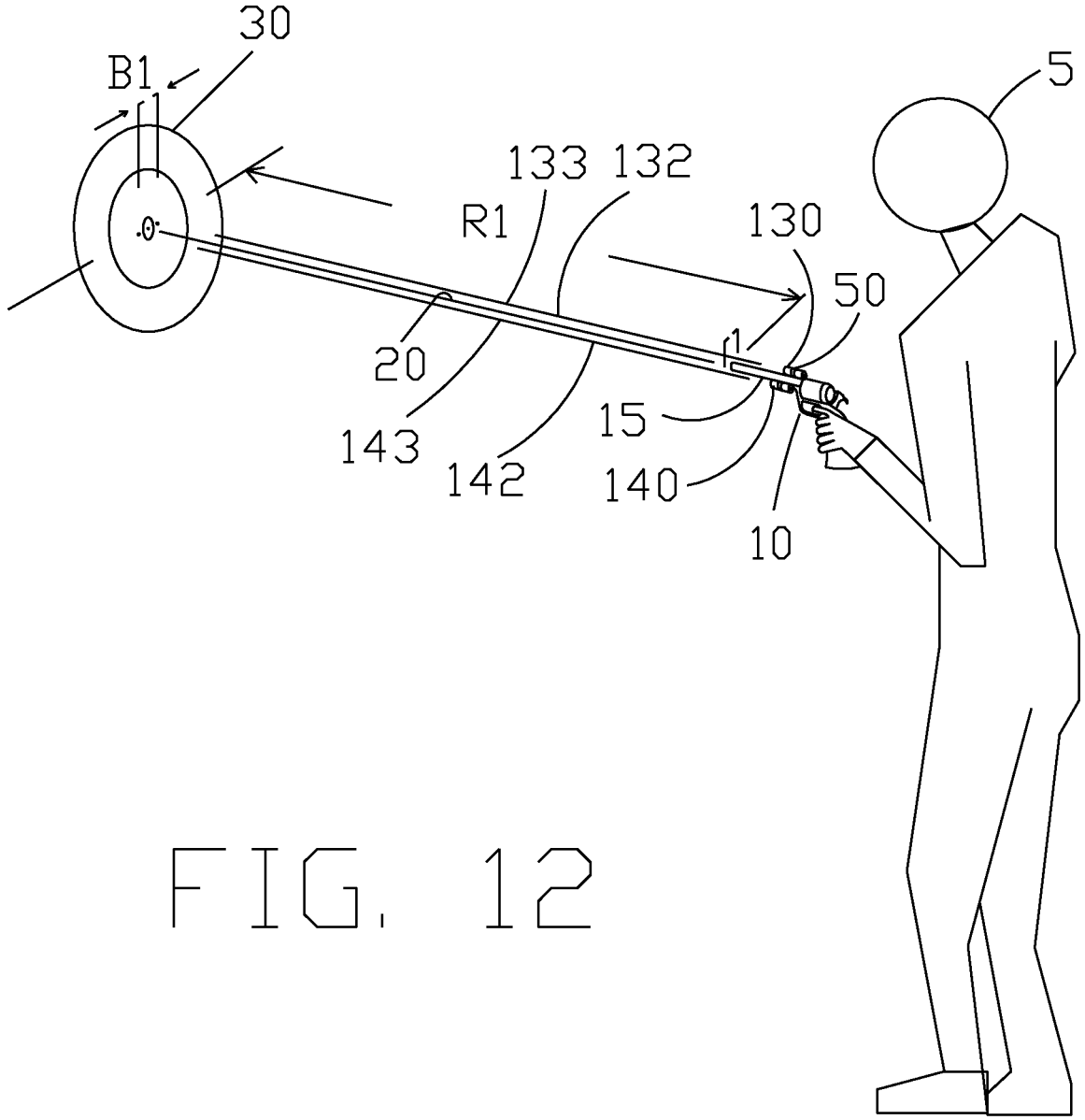
FIG. 12 is a perspective view showing the laser beams bracketing a target at a first given distance.
Figure 13:
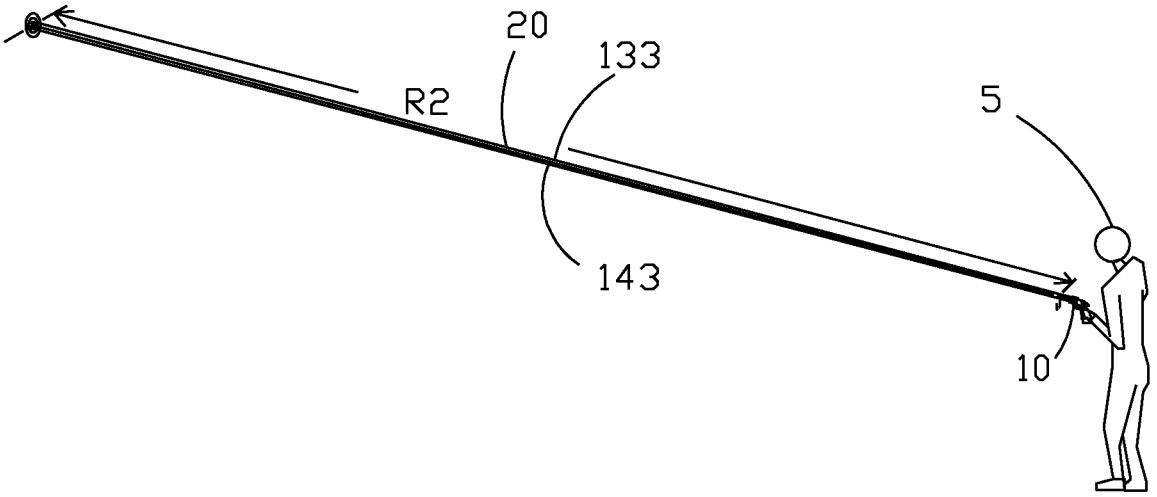
FIG. 13 is similar to FIG. 12 but shows the laser beams bracketing the target at a second distance.
Figure 13A:
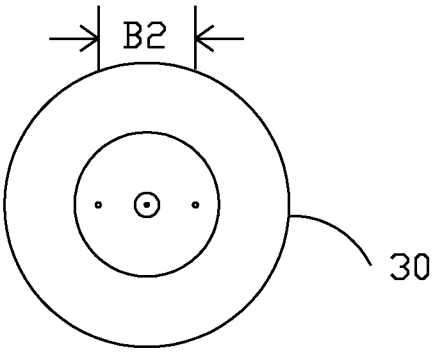
FIG. 13A is a close-up view showing the laser beams projected onto the target at the distance of FIG. 13.
Figure 14:
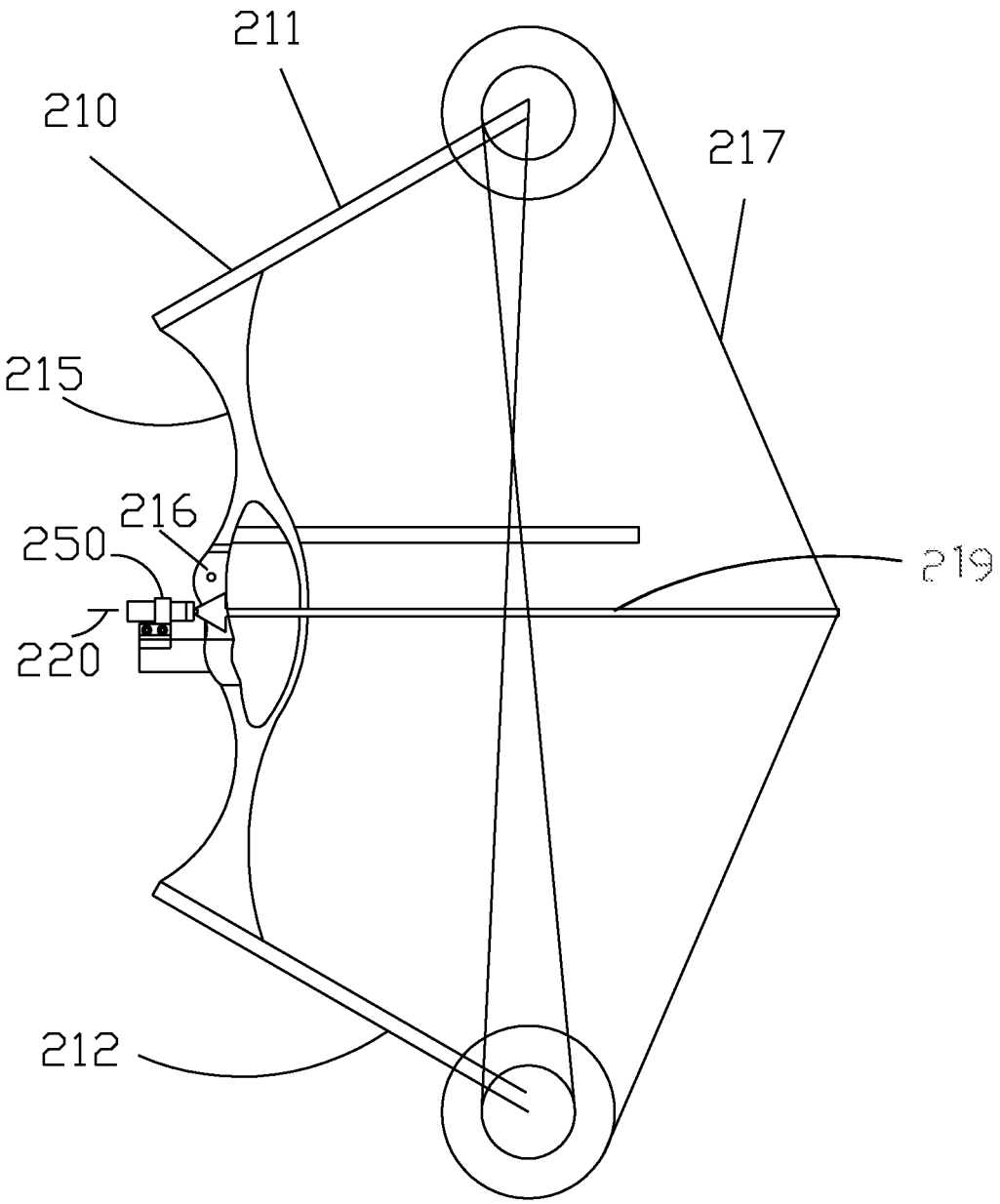
FIG. 14 is a side view showing an alternative embodiment of the present invention mounted to a bow sight.
Figure 15:
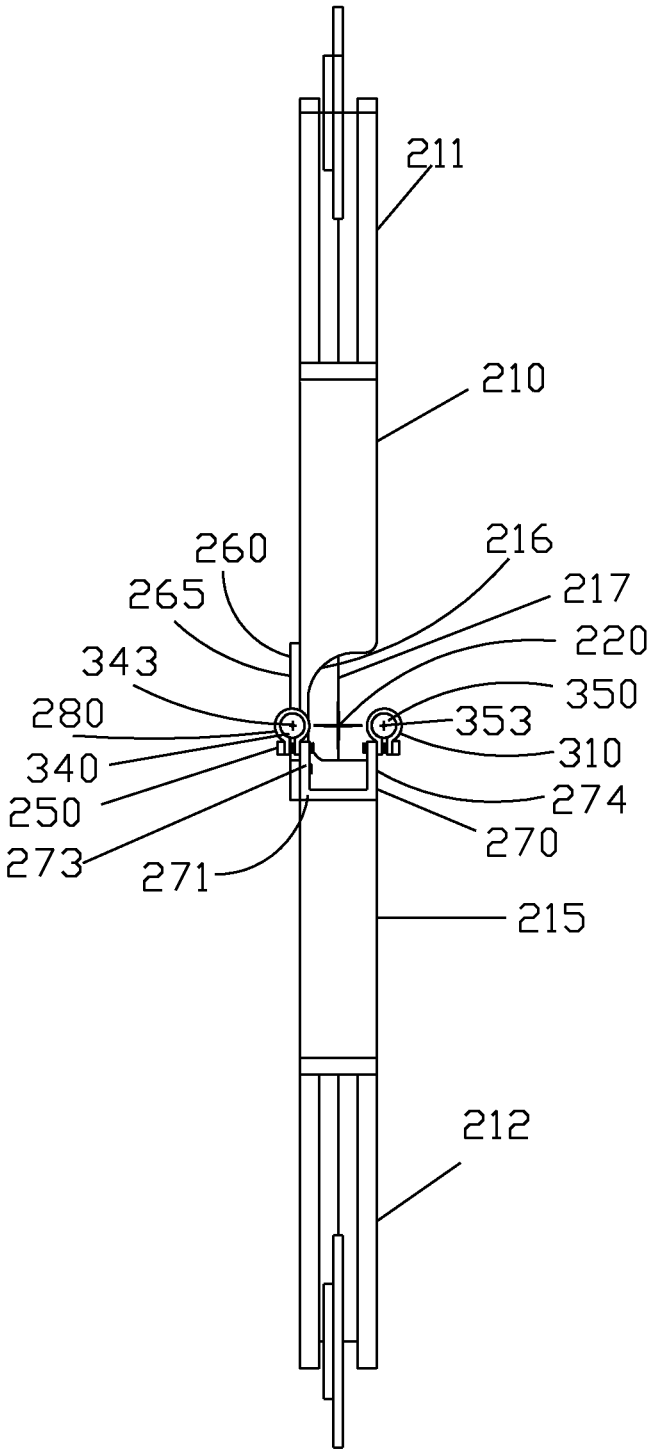
FIG. 15 is an end view of the embodiment illustrated in FIG. 14.
Figure 16:
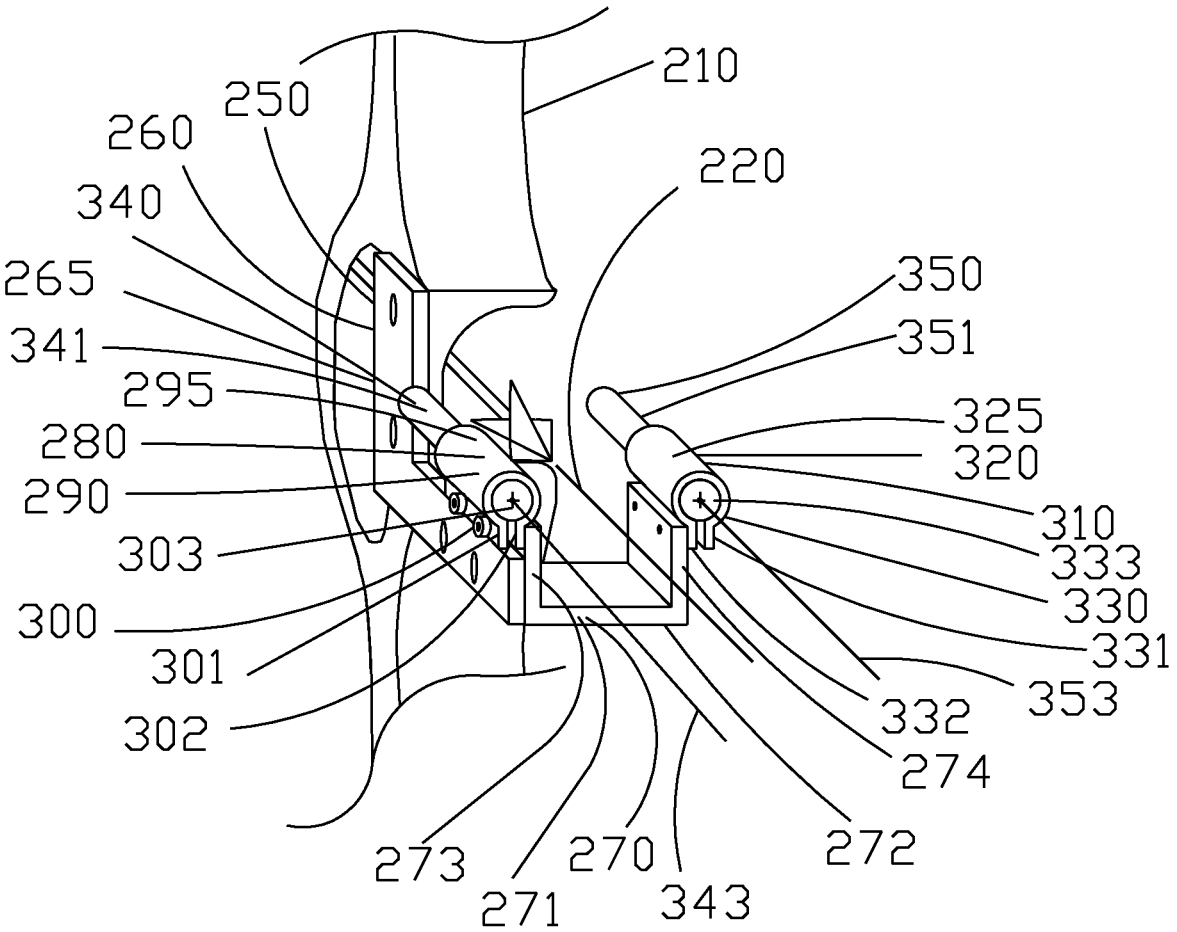
FIG. 16 is a partial perspective view of the embodiment illustrated in FIG. 14.
Figure 17:
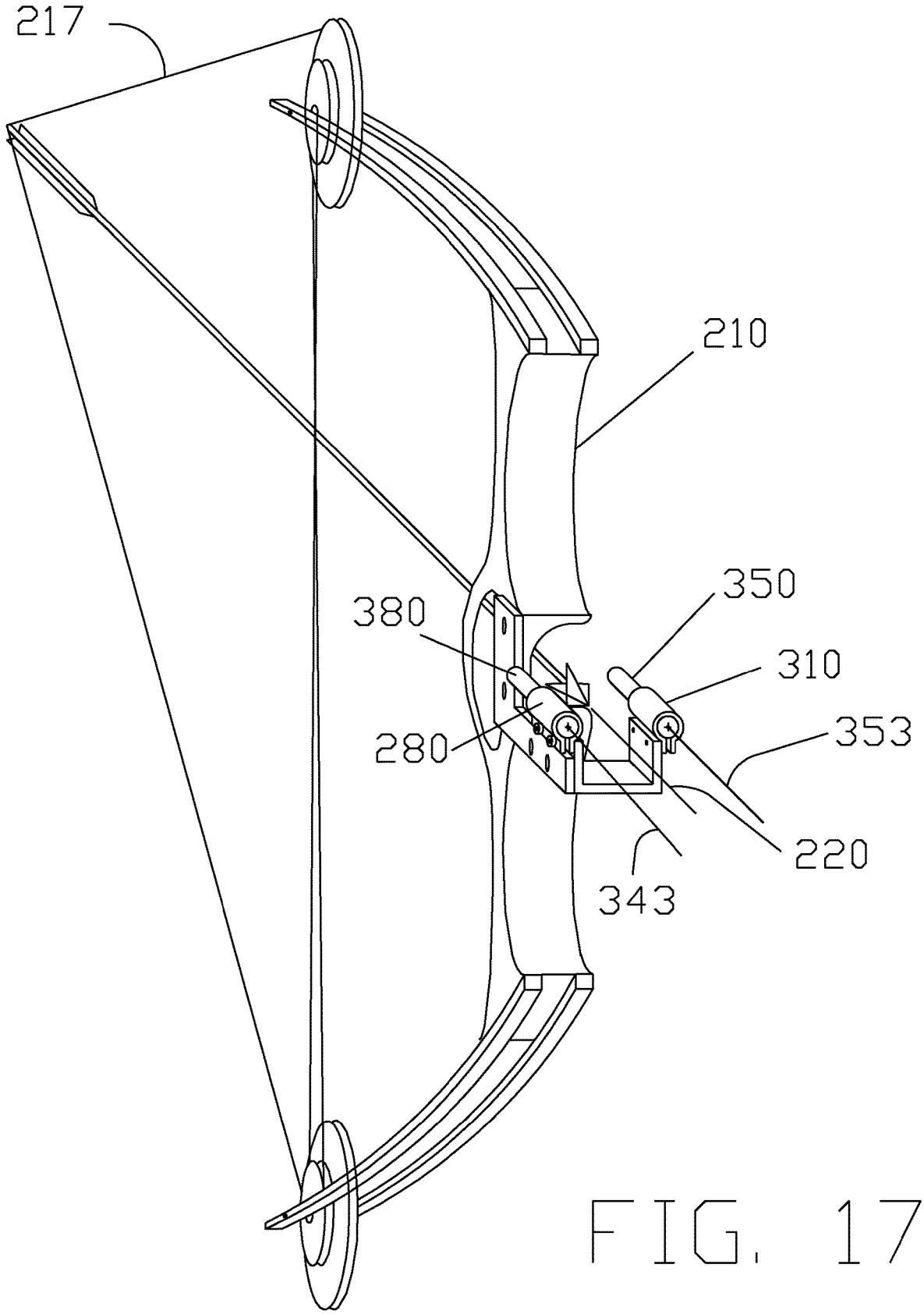
FIG. 17 is a perspective view of the embodiment illustrated in FIG. 14.
Figure 18:
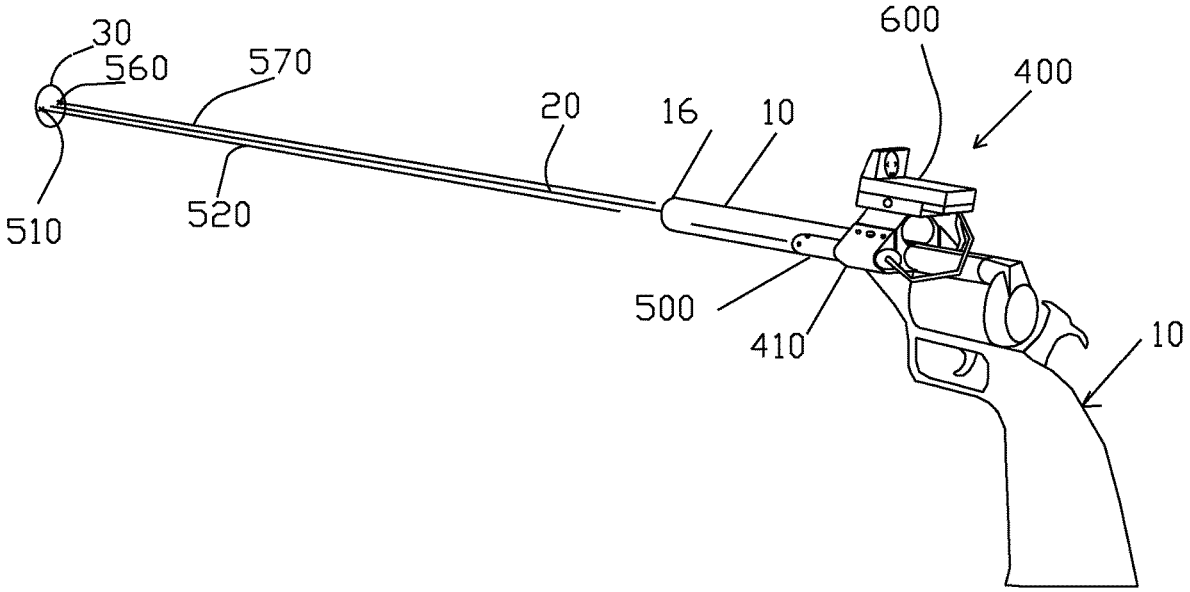
FIG. 18 is a perspective view of a two-camera sighting device.
Figure 19:
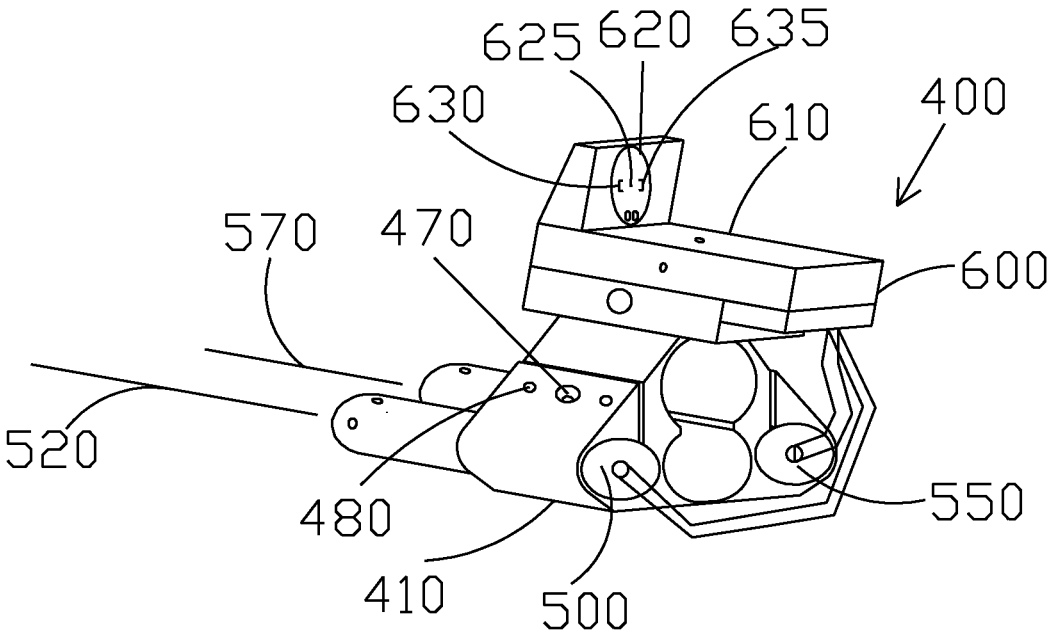
FIG. 19 is a perspective view of the barrel mount, cameras and integrated display shown in FIG. 18.
Figure 20:
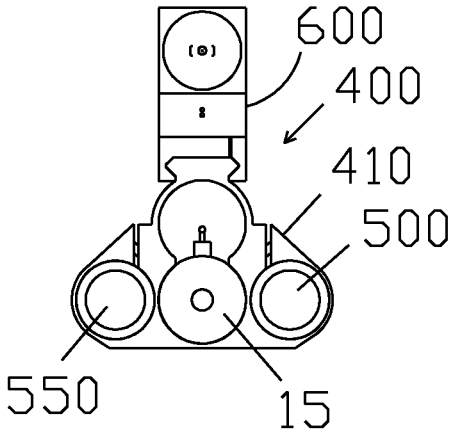
FIG. 20 is an alternative view of the components illustrated in FIG. 19.
Figure 21:
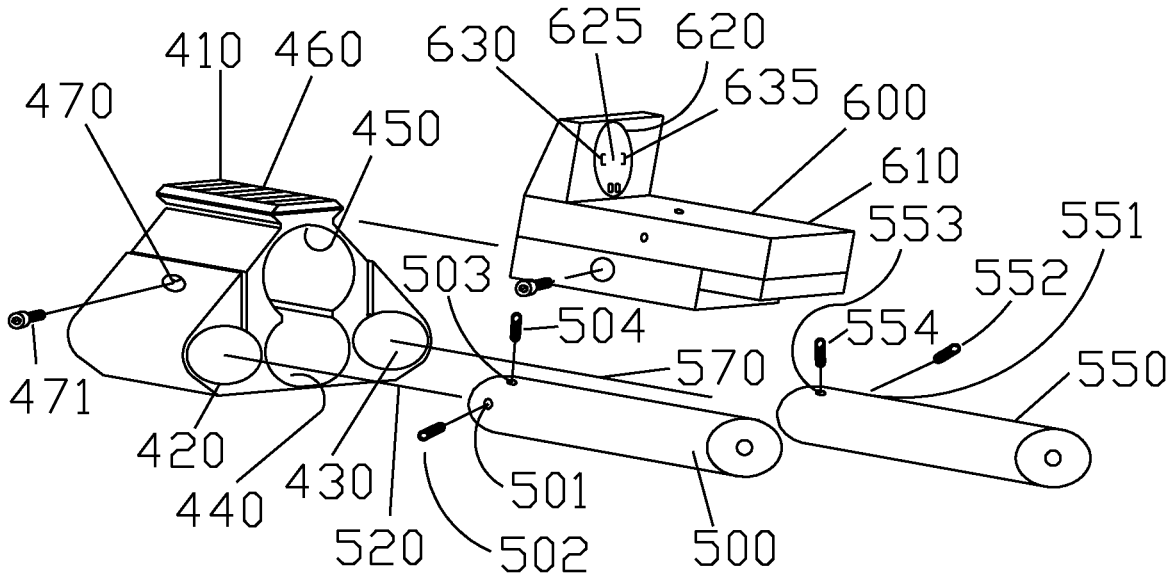
FIG. 21 is an exploded view of the components illustrated in FIG. 19.
Figure 22:
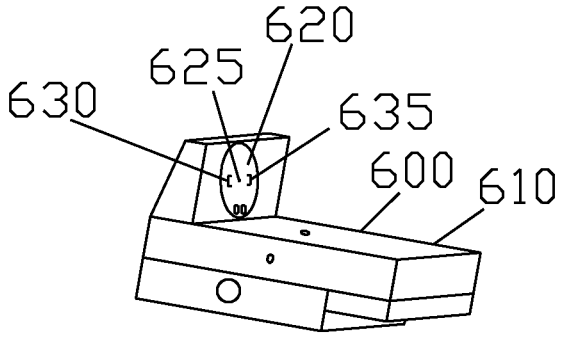
FIG. 22 is a perspective view of the integrated display.

Use of the present invention is illustrated in FIGS. 12 and 13, and in FIG. 13A. The laser beams 132 and 142 can be projected onto a target 30, wherein the laser beams bracket the projectile axis 20 that is centered on the target 30. In this regard, the user can simply align the center of the target 30 between the two laser dots to quickly and easily aim the firearm. Because of the slight divergence, the lasers, even when degraded at distance, do not converge into a single dot over the center of the target.

Figure 11:
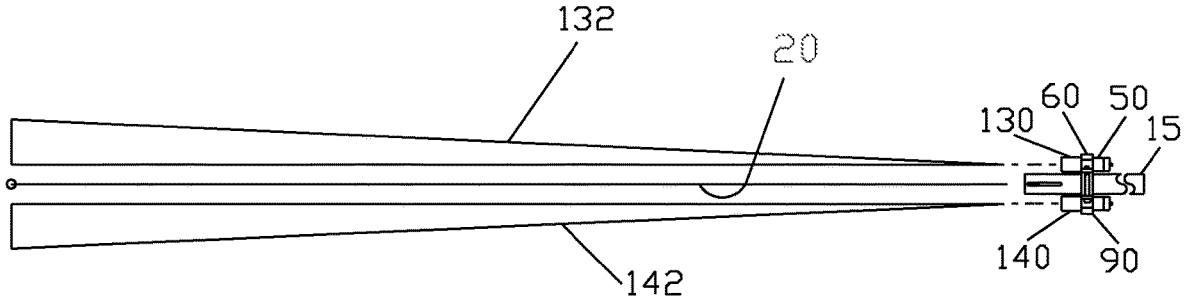
FIG. 11 is a view showing an embodiment where the lasers are mounted in a manner having divergent axis.

Further, also due to the laser divergence as illustrated in FIG. 11, the bracket area gets proportionally larger as the distance between the firearm and the target increase resulting in ease of bracketing the target at distance. In FIG. 12, at a first range R1, the bracket has a bracket spread B1. In FIG. 13, at a second range R2, the bracket has a bracket spread B2.

In one preferred embodiment, the lasers are separated by two inches initially. At R1=5 yards, the lasers can be separated so that B1=2.54 inches. At a range wherein R2=25 yards, the lasers can be separated so that B2=3.40 inches. As a further example, at a range of 100 yards, the lasers can be separated by a distance of 7.60 inches. It is also appreciated that the distance of separation is the distance between the center of the laser beams. Each dot, on account of degradation, has an increasing diameter at increased distance. If a bloom has a 2.0 inches diameter at 100 yards, the distance between the outer perimeter of the divergent lasers would be 5.6 inches. It is understood that other amounts of divergence are possible without departing from the broad aspects of the present invention.

Turning now to FIGS. 14-17, it is seen that an alternative embodiment is illustrated showing use with a bow 210. The bow 210 has limbs 211 and 212 and a riser 215. The riser 215 has a sight window 216. A string 217 is provided to propel a projectile 219 along a projectile axis 220.

The device 250 has a mount 260 with a sidewall 265 that is secured to the riser 215 in a traditional manner with screws. The mount 260 has a base 270 preferably rigidly secured to the side wall 265. The base 270 has opposed sides 271 and 272, respectively. An upright 273 is at side 271 and an upright 274 is at side 272. Each upright preferably has two holes there through.

A clamp 280 is provided having a wall 290. The wall has a top 295 and a bottom 300. There are two tabs 301 and 302 at the bottom 300. An opening 303 through the wall 290 is between the tabs 301 and 302. The tabs have aligned holes that are spaced to be alignable with holes in the upright 273. In this regard, the clamp 280 can be supported by and fastened to the upright 273 with two threaded bolts.

A clamp 310 is provided having a wall 320. The wall has a top 325 and a bottom 330. There are two tabs 331 and 332 at the bottom 330. An opening 333 through the wall 320 is between the tabs 331 and 332. The tabs have aligned holes that are spaced to be alignable with holes in the upright 274. In this regard, the clamp 310 can be supported by and fastened to the upright 274 with two threaded bolts.

A laser 340 with a body 341 that can project or shine a beam along a beam axis 343 is provided. The laser 340 is securely held with clamp 280.

A laser 350 with a body 351 that can project or shine a beam along a beam axis 353 is provided. The laser 350 is securely held with clamp 310.

The lasers 340 and 350 can be tuned when in place preferably by making internal adjustments once the lasers 340 and 350 are secured to the device. Given the relative short range of bows, the lasers can be selectably tuned to be parallel to each other or slightly divergent.

The beam axis 343 and 353 are planar with the projectile axis 220, wherein the lasers bracket the impact point on the target.

Turning now to FIGS. 18-24C, it is seen that an embodiment is illustrated having a dual camera device 400. The dual camera device 400 has a barrel mount 410, a first camera 500, a second camera 550 and a display that can be either an integrated display 600 or a non-integrated display 700. Each of these components are described below.

The barrel mount 410 is shown in FIGS. 18-21. The barrel mount 410 has two camera holes 420 and 430, respectively. The camera holes 420 and 430 are on opposite sides of a barrel hole 440. The barrel axis and center of the camera holes 420 and 430 can be horizontally aligned. A sight hole 450 can be located above the barrel hole 440. In this regard, a user can view the gun sights through the sight hole 450 and also can have a direct line of sight to the target through the sight hole 450. A mount 460, such as a Picatinny rail, can be atop of the barrel mount 410. The sides of the barrel mount 410 have mounting screw holes 470 for receiving mounting screws 471. The sides of the barrel mount 410 also have adjusting screw holes 480 for receiving adjusting screws 481.

A camera 500 is provided. The camera 500 is preferably a digital camera that can capture and send data, and that can preferably operate in visible light or invisible light (example infrared) frequencies. The camera 500 has a focal point 510 and can have an image path 520 to the focal point 510. An optional range finder can be integrated into the camera 500. Camera 500 is preferably a HD camera.

A camera 550 is provided. The camera 550 is preferably a digital camera that can capture and send data, and that can preferably operate in visible light or invisible light (example infrared) frequencies. The camera 550 has a focal point 560 and can have an image path 570 to the focal point 560. Camera 550 is preferably a HD camera.

An integrated display 600 can also be provided. The integrated display 600 has a body 610 containing a processor or CPU. The display 600 further has a display screen 620 that can display reticles 630 and 635 around a target 625. The screen 620 can be a clear reflex screen wherein the reticles 630 and 635 are projected onto the screen and the user can view the reticles in relation to the target.

The barrel mount 410 can be mounted to the barrel 15 of a firearm 10. Camera 500 can be inserted into camera hole 420. Camera 550 can be inserted into camera hole 430. Then, the barrel mount 410 and cameras 500 and 550 are secured in place by inserting mounting screws 471 through holes 470 to compress the mount to the camera body. Screw 502 is adjusted within hole 501 to adjust the horizontal position of the camera 500. Screw 504 is adjusted within hole 503 to adjust the vertical position of the camera 500. Screw 552 is adjusted within hole 551 to adjust the horizontal position of the camera 550. Screw 554 is adjusted within hole 553 to adjust the vertical position of the camera 550. The internal camera 500 and 550 adjustments are made after the cameras are secured to the device. The camera adjustments are made so that the focal points 510 and 560, respectively, are aligned with, but offset from, the barrel axis (also the projectile axis 20). A screw can be used to secure an integrated display 600 to the rail 460 (in embodiment where an integrated display is used). The display 600 can be hard-wired or wirelessly connected to the cameras 500 and 550.

It is appreciated that a non-integrated display 700 such as a hand-held device (phone, etc.) can be used in place of an integrated display 600. The non-integrated display has a body 710 housing a processor or CPU. It further has a display screen 720 that can display representations 725 of the target and reticles 730 and 735. Displays of an integrated display and non-integrated displays can display similar information thereon.

Figure 23:
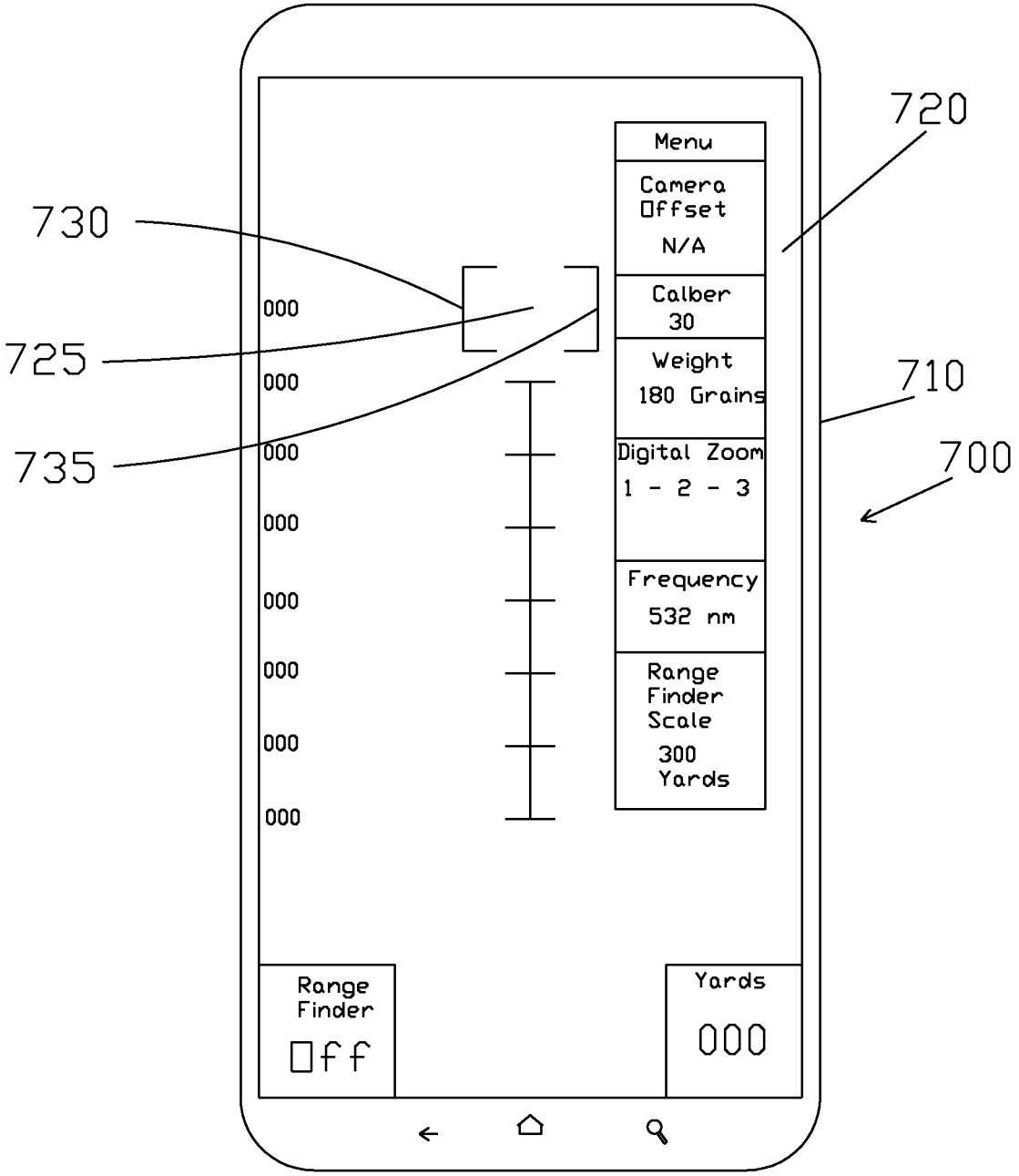
FIG. 23 is a view of a menu screen on a hand-held display.

A menu screen is illustrated in FIG. 23. It is seen that a range finder on/off is at the lower left of the display screen 720. Yardage range is scaled on the left side of the screen. On the right side of the screen, user inputs such as camera offset, caliber, weight, digital zoom, frequency and range are shown. These inputs are useful when the target is located at a range when the projectile will deviate from (i.e. fall below) the barrel axis. It is noteworthy, that the camera offset feature is listed as N/A in this embodiment as the camera image paths are vertically aligned in a horizontal plane with the barrel axis in a non-adjustable fixed position in this dual camera device 400.

Figure 24:
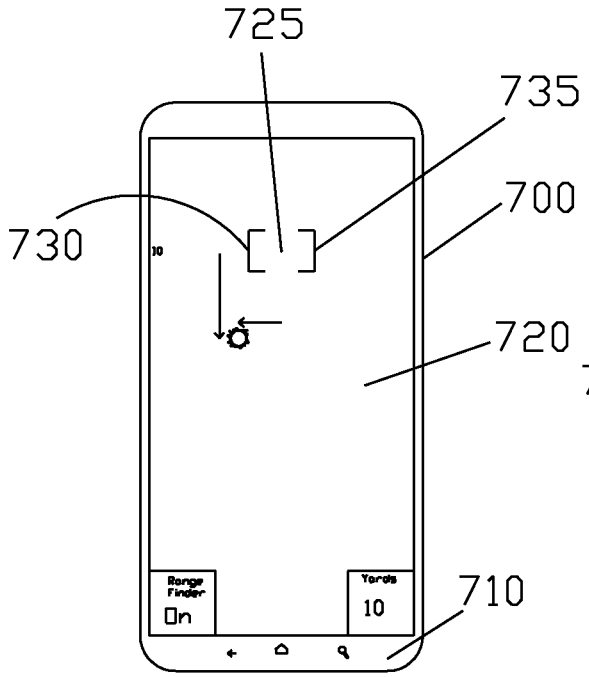
FIGS. 24, 24A, 24B and 24 C illustrate steps used to sight-in the present invention.
Figure 24A:
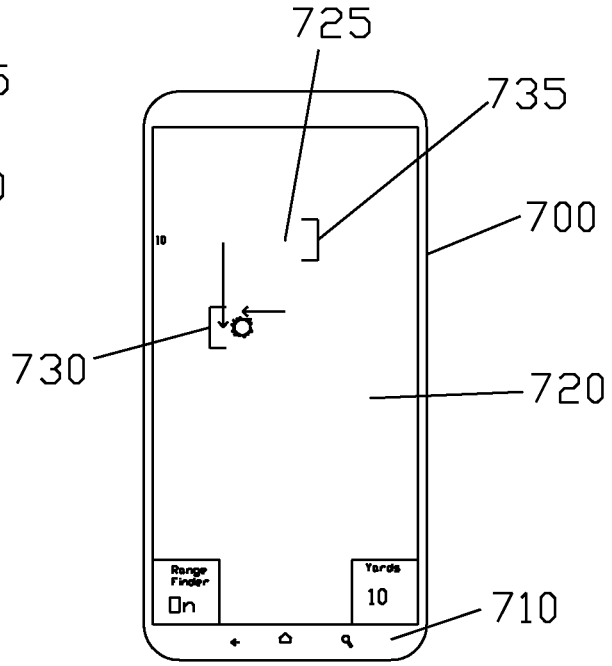
Figure 24B:
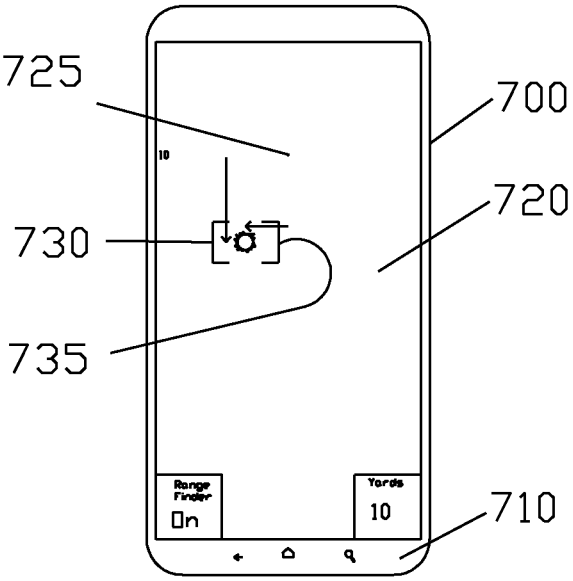
Figure 24C:
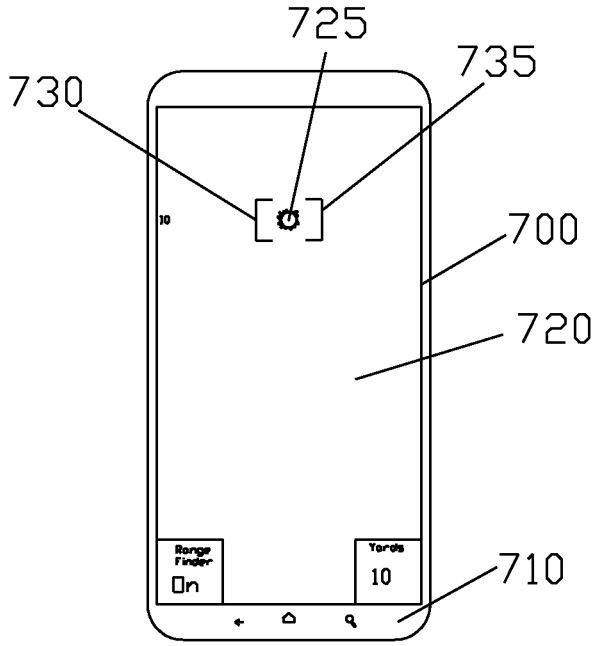

The steps to tune the device are illustrated in FIGS. 24-24C. A shot is fired as represented in FIG. 24. Given that the shot is, for example, low and left, the left camera is adjusted accordingly until the left reticle 730 is properly aligned as seen in FIG. 24A. Then, the right camera is adjusted accordingly until the right reticle 735 is properly aligned as seen in FIG. 24B. The cameras are independently tunable. Now, in FIG. 24C, it is seen that the reticles 730 and 735 are aligned to bracket the representation 725 of the target. Stated another way, once tuned, the cameras are positioned such that their image paths are parallel to each other and are equidistant from the projectile axis and barrel axis.

Turning now to FIGS. 25-32A, it is seen that an embodiment is illustrated having a single camera device 800. The single camera device 800 has a barrel mount 810, a camera 900 and a display that can be either an integrated display 1000 or a non-integrated display 1100. Each of these components are described below.

Figure 25:
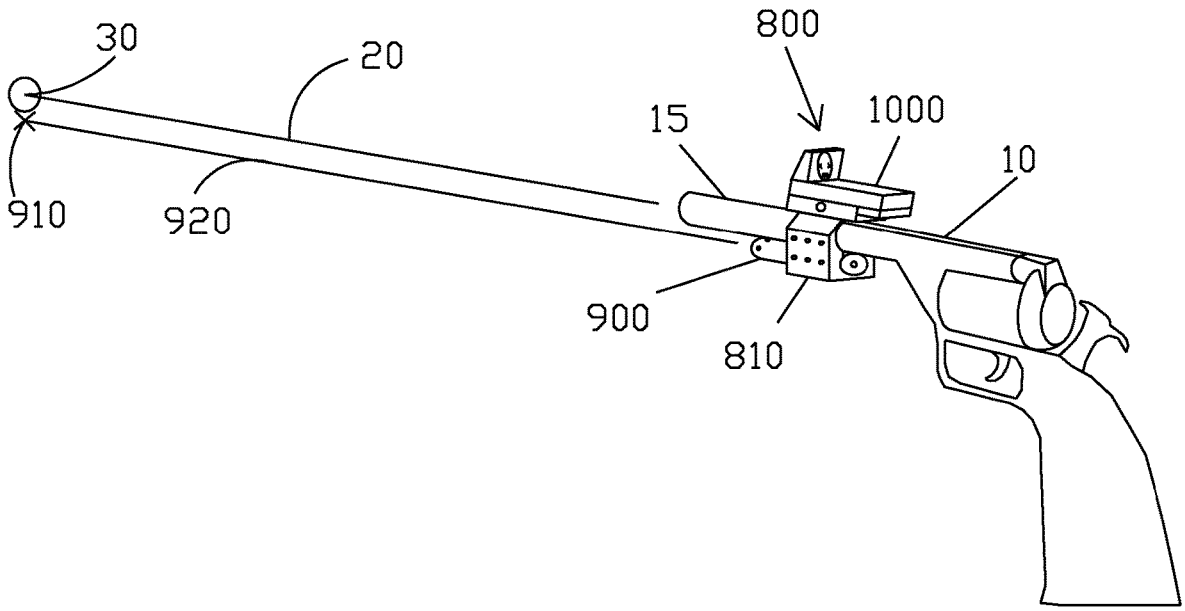
FIG. 25 is a perspective view of a single-camera sighting device.
Figure 26:
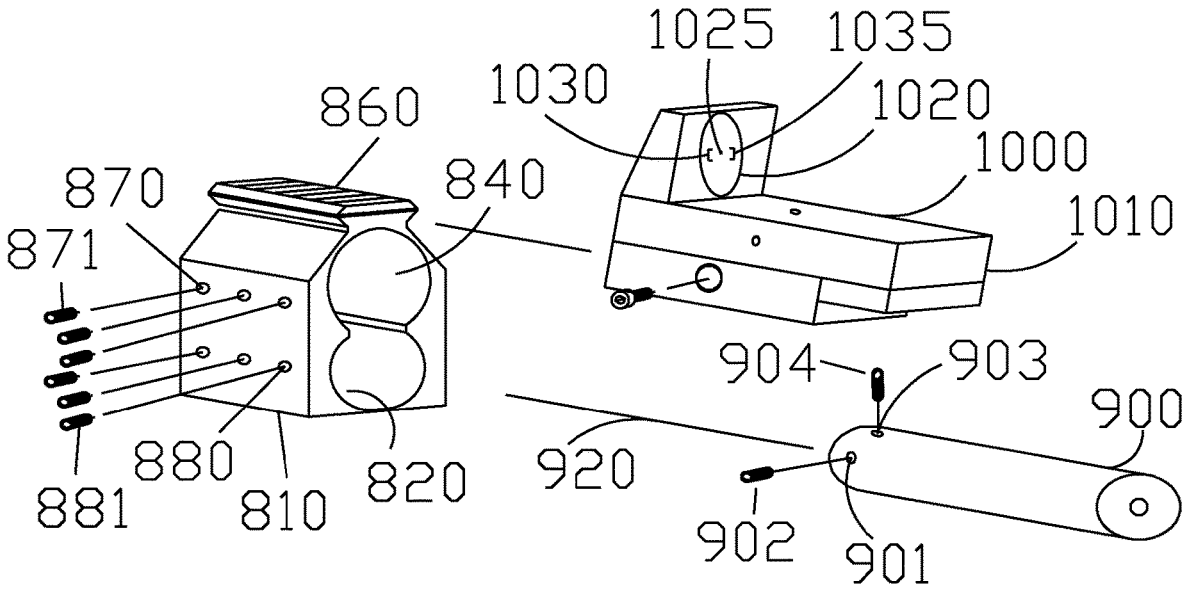
FIG. 26 is an exploded view of the barrel mount, integrated display and camera illustrated in FIG. 25.

The barrel mount 810 is shown in FIGS. 25 and 26. The barrel mount 810 has a camera hole 820. The camera hole 820 is located directly below a barrel hole 840. The barrel axis and center of the camera hole 820 are vertically aligned. The holes 840 and 820 could alternatively be horizontally aligned. A mount 860, such as a Picatinny rail, can be atop of the barrel mount 810. The sides of the barrel mount 810 have mounting screw holes 870 for receiving mounting screws 871. The sides of the barrel mount 810 also have adjusting screw holes 880 for receiving screws 881 for further support.

A camera 900 is provided. The camera 900 is preferably a digital camera that can capture and send data, and that can preferably operate in visible light or invisible light (example infrared) frequencies. The camera 900 has a focal point 910 and can have an image path 920 to the focal point 910. An optional range finder can be integrated into the camera 900. Camera 900 is preferably a HD camera. Screw 902 is adjusted within hole 901 to adjust the horizontal position of the camera 900. Screw 904 is adjusted within hole 903 to adjust the vertical position of the camera 900. Horizontal and vertical adjustments of the camera are made after the camera is secured within the camera hole 820.

An integrated display 1000 can also be provided. The integrated display 1000 has a body 1010 containing a processor or CPU. The display 1000 further has a display screen 1020 that is clear so that a target 1025 can be viewed in proximity to reticles 1030 and 1035 projected onto the display screen 1020. In this regard, the integrated display can be a reflex display.

The barrel mount 810 can be mounted to the barrel 15 of a firearm 10. Camera 900 can be inserted into camera hole 820. Mounting screws 871 can be inserted through mounting holes 870 to secure the barrel mount 810 to the barrel 15. Then, the camera 900 is inserted into the camera hole 820. Adjusting screws 881 can be selectively moved into or out of holes 880 to clamp the camera 900. Internal adjustments are then made within the camera so that the focal point 910 is vertically aligned with the barrel axis (also the projectile axis 20). A screw can be used to secure an integrated display 1000 to the rail 860 (in embodiment where an integrated display is used). The display 1000 can be hard-wired or wirelessly connected to the camera 900.

It is appreciated that a non-integrated display 1100 such as a hand-held device (phone, etc.) can be used in place of an integrated display 1000. The non-integrated display has a body 1110 housing a processor or CPU. It further has a display screen 1120 that can display representations 1125 of the target and reticles 1130 and 1135. Displays of an integrated display and non-integrated displays can display similar information thereon.

Figure 27:
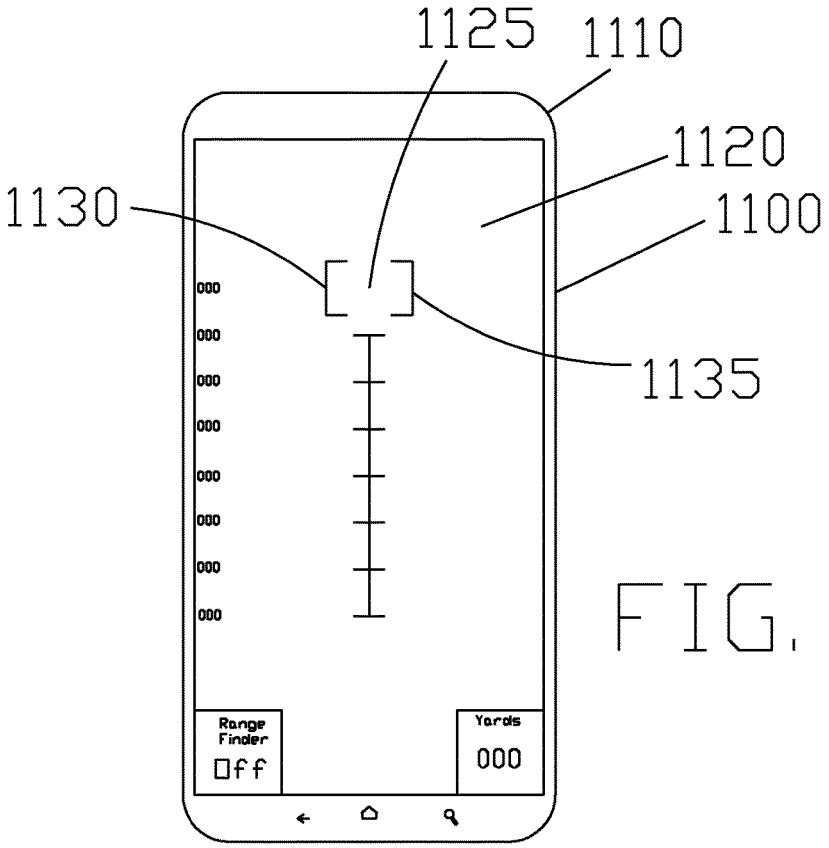
FIG. 27 is a view showing a basic screen on a hand-held display.

A basic display screen 1120 is illustrated in FIG. 27 before a menu is brought up.

Figure 28:
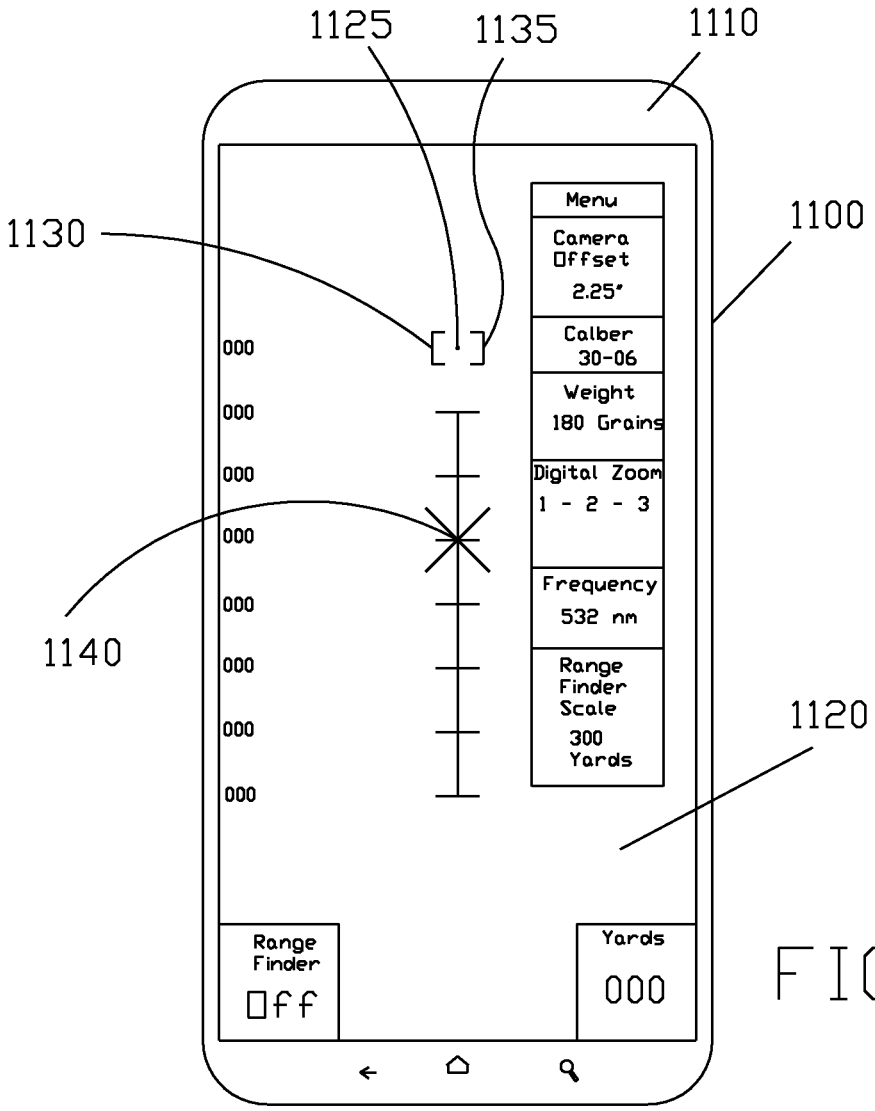
FIG. 28 is a view of a menu screen on a hand-held display.

A menu screen is illustrated in FIG. 28. It is seen that a range finder on/off is at the lower left of the display screen 1120. Yardage range is scaled on the left side of the screen. On the right side of the screen, user inputs such as cameral offset, caliber, weight, digital zoom, frequency and range scale are shown. These inputs are useful when the target is located at a range when the projectile will deviate from the barrel axis. Camera offset is the distance between the camera image path 920 and the barrel axis and projectile axis. The single camera device automatically places the reticles 1130 and 1135 vertically upwards by the camera offset distance to compensate for the vertical offset of the optical focal point 1140.

It is appreciated that with a single camera, that the left and right reticles move in unison when adjustments are made to the orientation of the camera 900 relative to the barrel mount 810.

Figure 29:
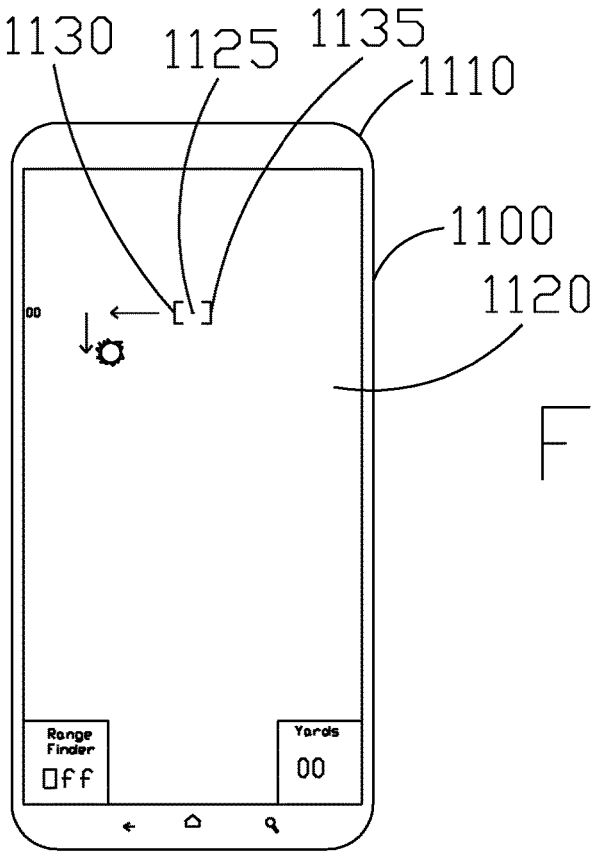
FIGS. 29 and 29A illustrate steps to sight-in the system with the range finder turned off.
Figure 29A:
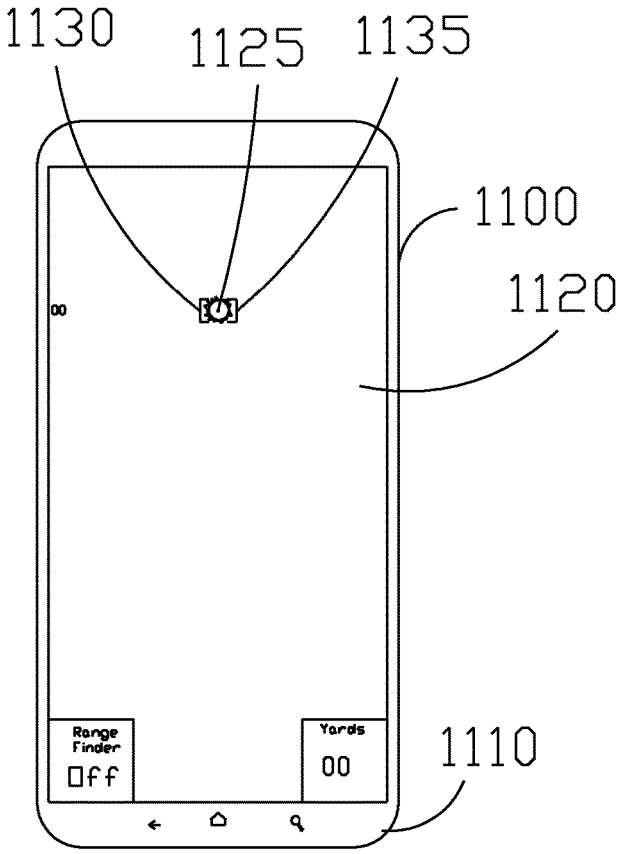

The device 800 can be tuned with or without the range finder being activated. The devices 800 is illustrated as being tuned without the range finder in FIGS. 29 and 29A. In this initial test, the shot is fired low and left of the initial target. Hence, adjustment of the camera is made lower (Y axis) and left (X axis) so that in subsequent shots (FIG. 29A) then reticles 1130 and 1135 bracket the target representation 1125. It is appreciated that this is illustrative in nature, and the adjustments can be made both positive and negative of both of the X and Y axis.

Figure 30:
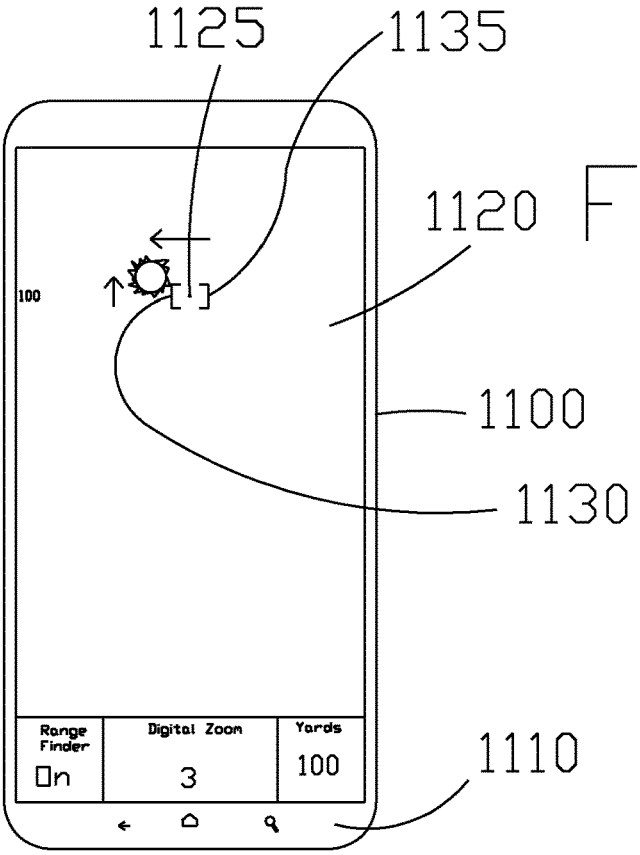
Figure 30A:
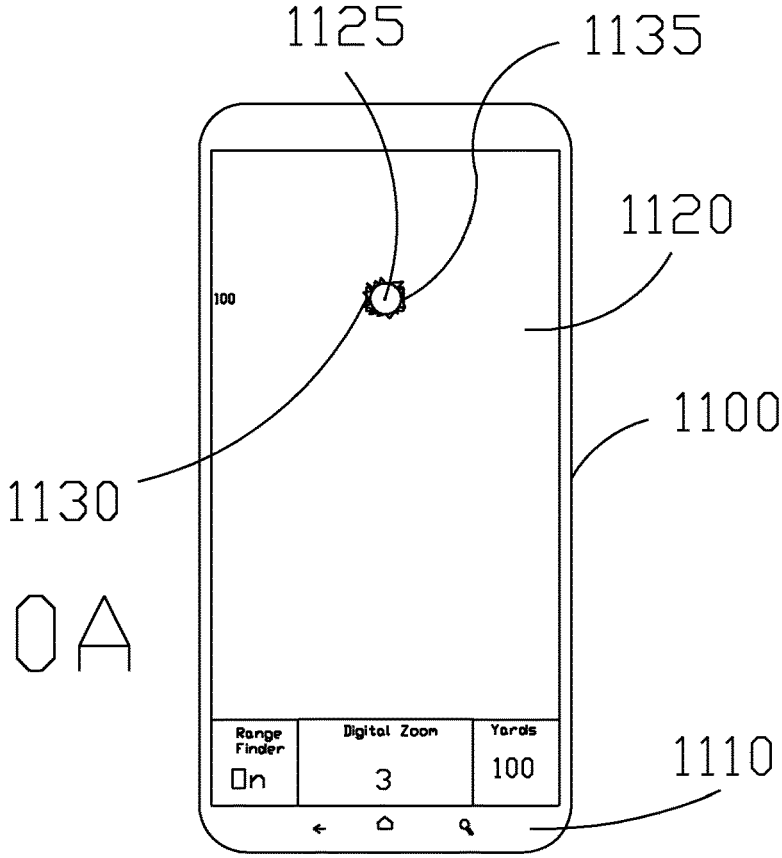

FIGS. 30 and 30A illustrate adjustment that are made when the range finder is on. For example, a test shot is fired at 100 yards. It is noted that the shot hit up and left from the intended target. The camera 900 can then be adjusted so that subsequent shots hit the target area which is bracketed by reticles 1130 and 1135.

Figure 31:
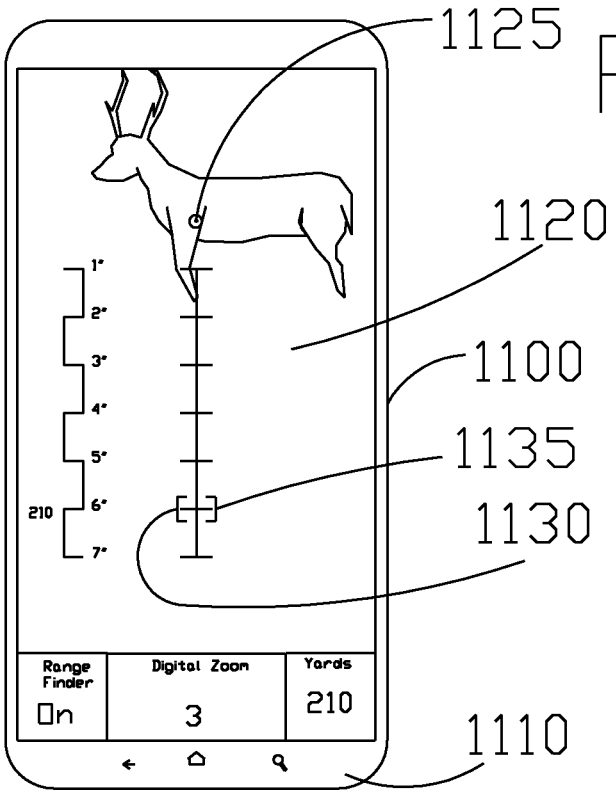
FIGS. 31 and 31A illustrate steps to compensate for the drop in projectile at range with optical zoom.
Figure 31A:
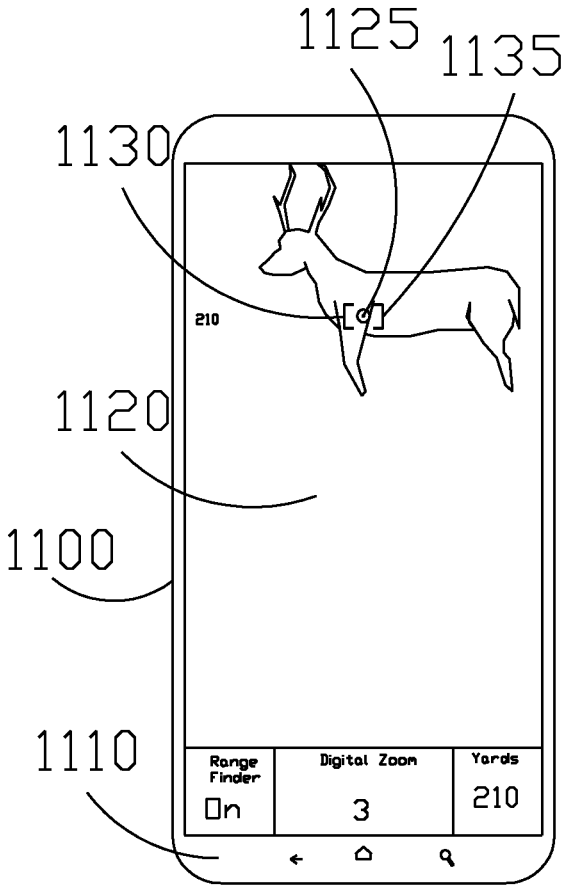

Range finder operation is illustrated in FIGS. 31 and 31A. Note that the range finder is on and distance is calculated to be 210 yards. Digital zoom is at three so that the target representation is larger on the screen 1120. Given inputs of caliber and weight, the CPU determines that there will be six inches of drop in the projectile. Hence, the user raises the barrel until the reticles 1130 and 1135 are on target as seen in FIG. 31A.

Figure 32:
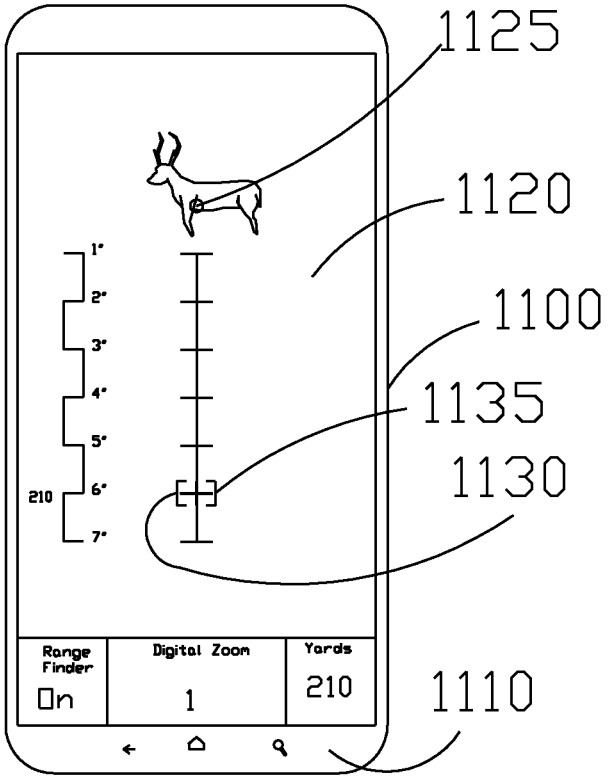
FIGS. 32 and 32A illustrate steps to compensate for the drop in projectile at range with optical zoom automatically adjusting from 1 to 3 times normal in increase size of the target on the display screen.
Figure 32A:
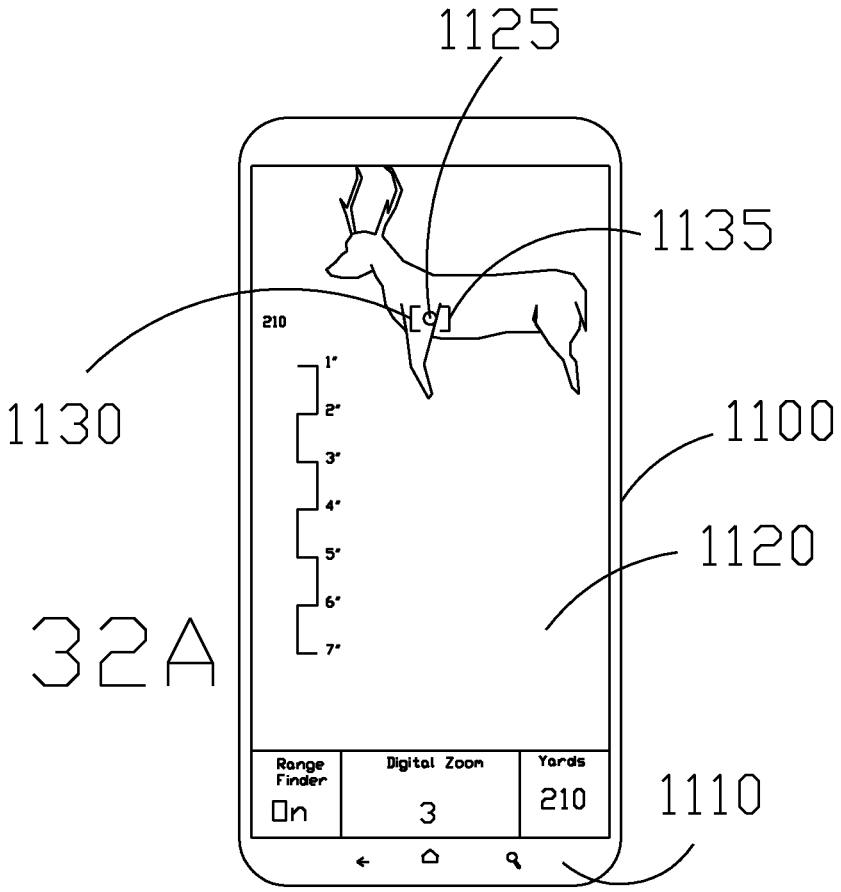
Figure 33:
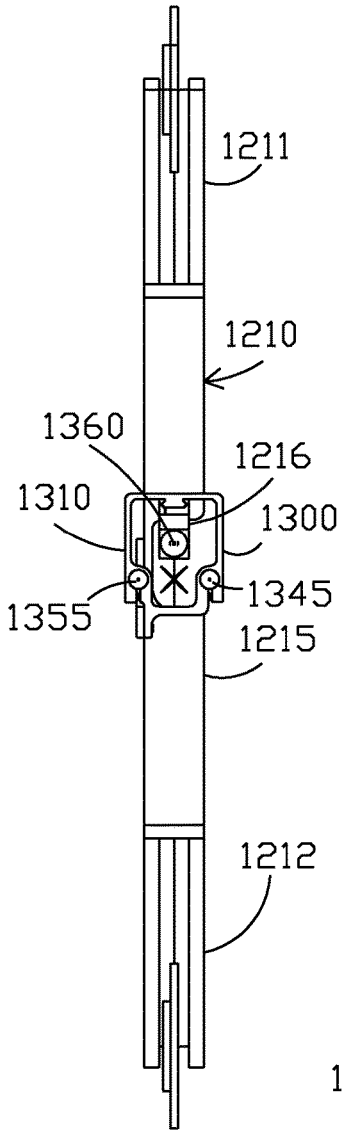
FIG. 33 is a front view of an embodiment having two cameras used with a bow.
Figure 34:
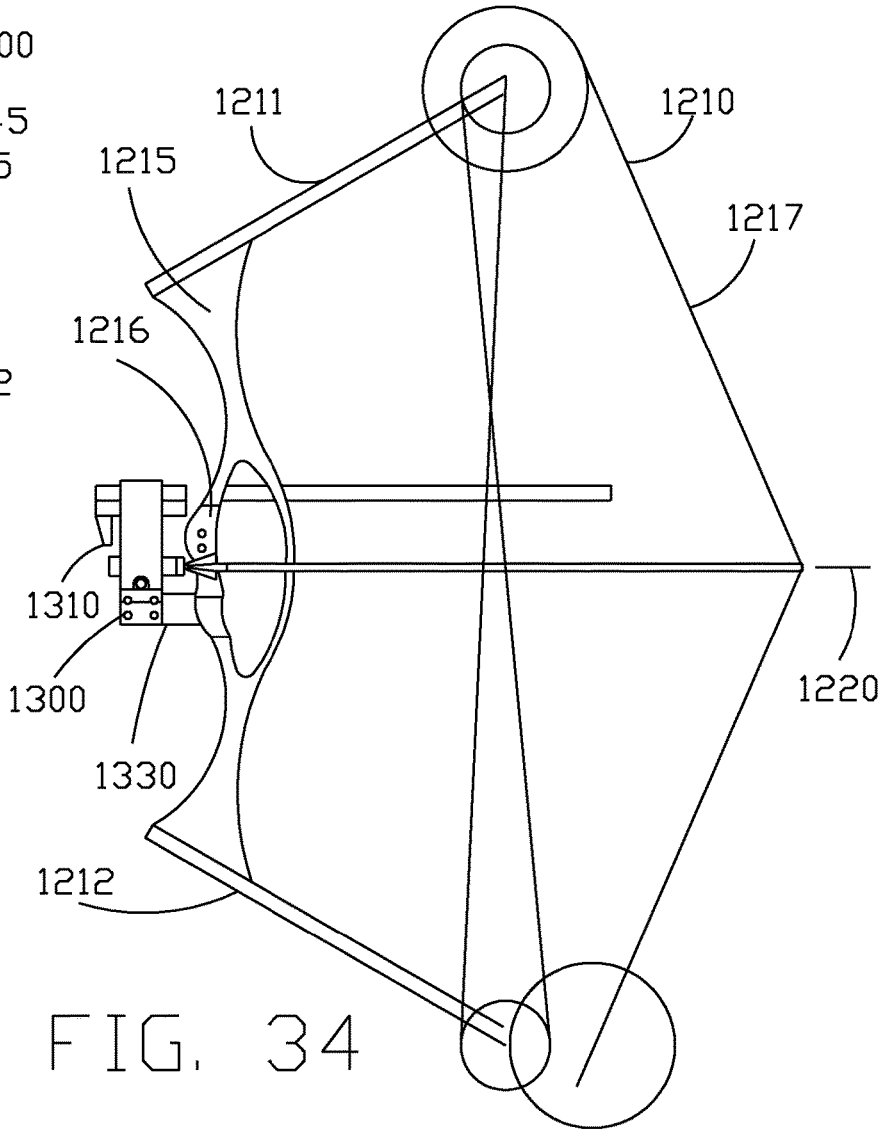
FIG. 34 is a side view of the embodiment illustrated in FIG. 33.
Figure 35:
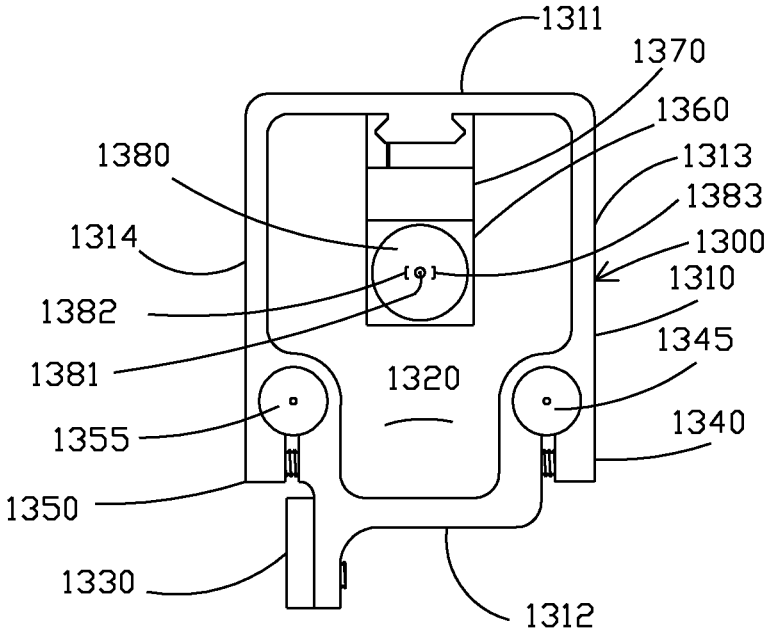
FIG. 35 a front view of the device illustrated in FIG. 33.
Figure 36:
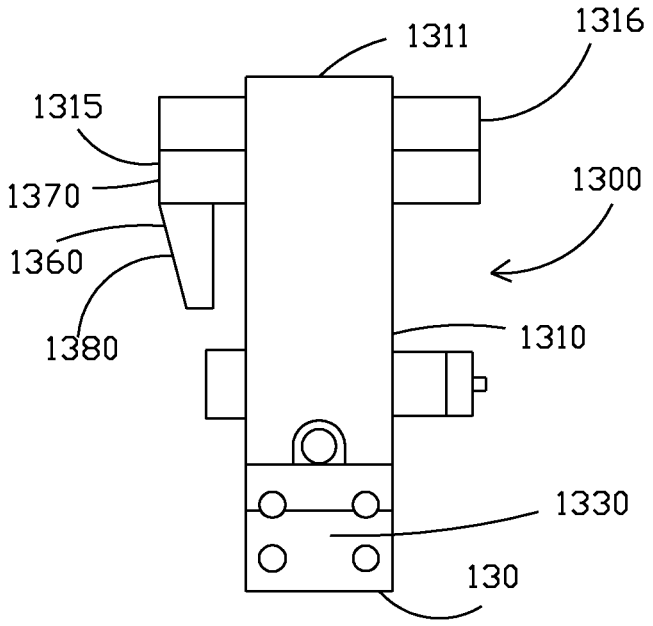
FIG. 36 is a side view of the device illustrated in FIG. 35.
Figure 37:
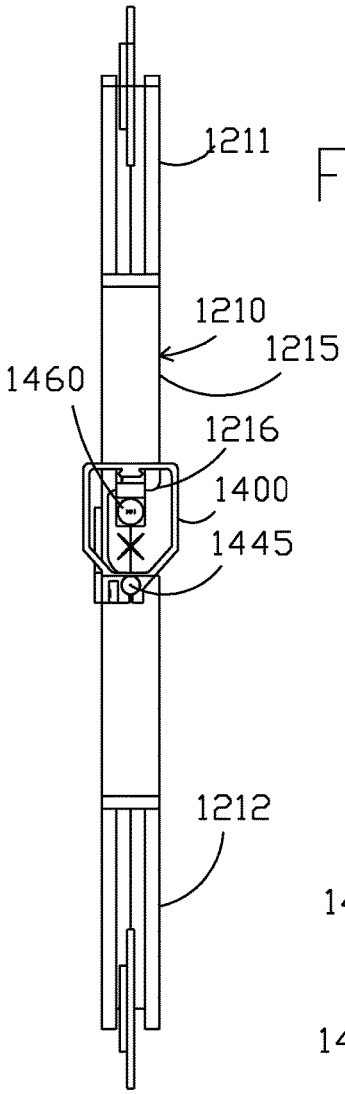
FIG. 37 is a front view of an embodiment having a single camera used with a bow.
Figure 38:
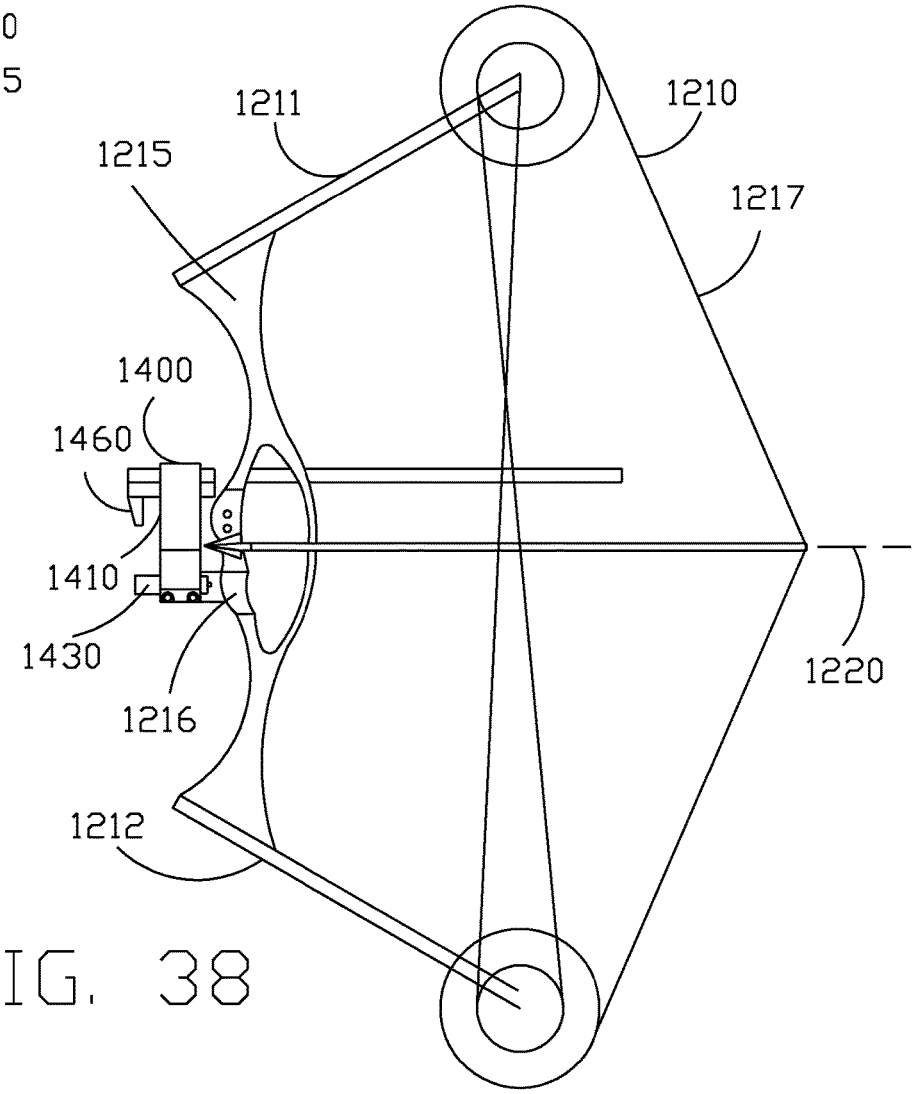
FIG. 38 is a side view of the embodiment illustrated in FIG. 37.
Figure 39:
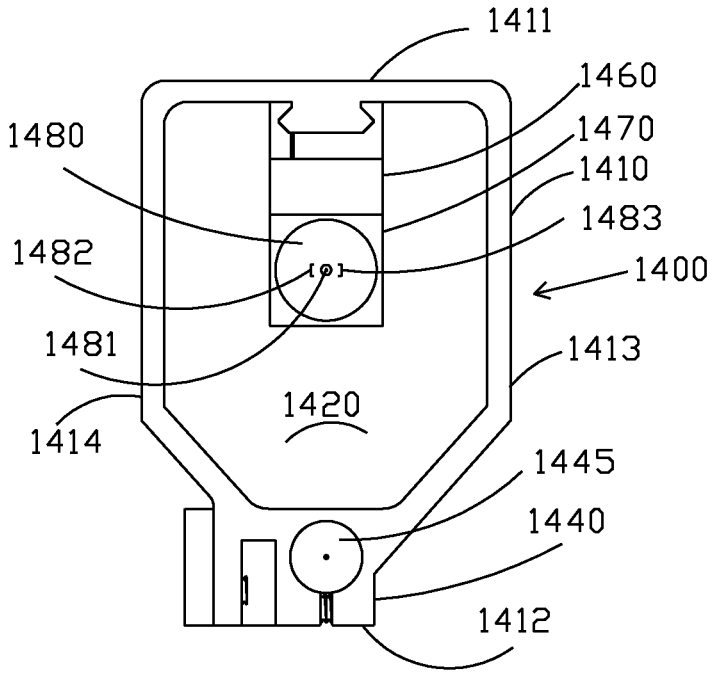
FIG. 39 a front view of the device illustrated in FIG. 37.
Figure 40:
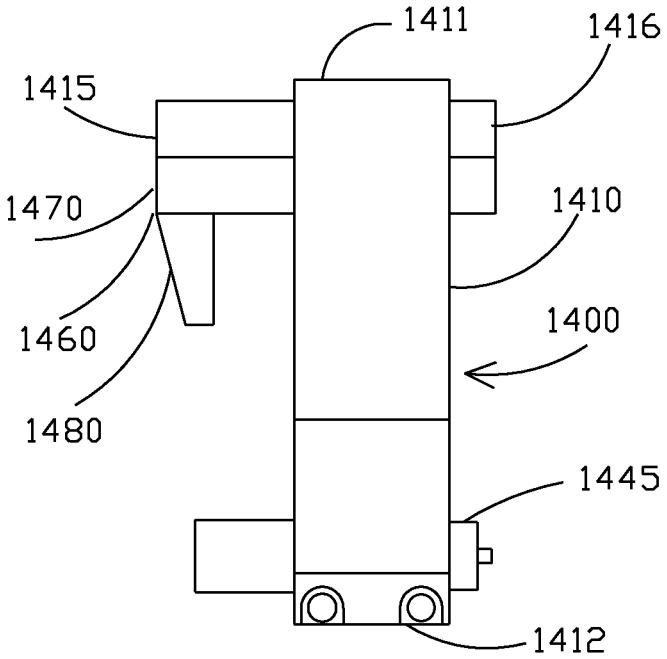
FIG. 40 is a side view of the device illustrated in FIG. 39.

FIG. 32 is similar to FIG. 31 but instead shows the target without any digital zoom. FIG. 32A shows the digital zoom switched to a digital zoom of 3 for better viewing by the user.

It is appreciated that the single and dual camera systems are described in relation to a firearm in the illustrated embodiment. Yet, it is appreciated that a firearm is only one type of projectile launching device. Other types of projectile launching devices include bows (compound, cross-bows or otherwise), cannons, compressed air projecting devices or other devices.

Further, while the barrel axis and projectile axis have been used herein, other axis may be similarly used. For example, an arrow projection axis could be used to describe the initial path of a projected arrow.

Still further, while a barrel is illustrated as an example of a suitable base structure, it is appreciated that other device base structures could be alternatively used without departing from the broad aspects of the present invention. For, example, a mount could be connected to a riser of a bow.

Turning now to FIGS. 33-36, it is seen that a further preferred embodiment of the present invention is illustrated. A bow 1210, having limbs 1211 and 1212 separated by a riser 1215 is shown. The riser 1215 has a sight window 1216. A string 1217 is provided. Projectile can be projected along a projectile axis 1220.

The embodiment of the device 1300 illustrated in FIGS. 33-36 has a frame 1310 with a top 1311, a bottom 1312, a side 1313, a second side 1314, a front 1315 and a rear 1316. There is preferably an opening 1320 through the frame 1310 open to both the front 1315 and rear 1316.

A mount 1330 is provided for connecting the device 1300 to the riser. A clamp 1340 secures a camera 1345 on one side of the frame 1310. A second clamp 1350 secures a second cameral 1355 on the opposite side of the frame 1310. The cameras 1345 and 1355 are sighted-in and operate similar to the cameras described above. The cameras are preferably digital cameras that can capture and send data to a processor and can operate with visible and invisible light (example is infrared).

An integrated display 1360 with a body 1370 and display screen 1380 showing the target 1381 and reticles 1382 and 1383 is provided. The display 1360 operates similar to the integrated displays described above.

A user can project a projectile along the projectile axis that extends through the opening 1320 in the frame 1310.

The user can view the screen 1380 from their usage view point behind the bow by looking through the sight window 1216.

Turning now to FIGS. 37-40, it is seen that a further preferred embodiment of a device 1400 of present invention is illustrated. The device 1400 has a frame 1410 with a top 1411, a bottom 1412, a side 1413, a second side 1414, a front 1415 and a rear 1416. There is preferably an opening 1420 through the frame 1410 open to both the front 1415 and rear 1416.

A mount 1430 is provided for connecting the device 1400 to the riser. A clamp 1440 secures a camera 1445 on the bottom 1412 of the frame preferably equidistant between the sides 1413 and 1414. The camera 1445 is sighted and operates similar to the single camera device described above. The camera is preferably a digital camera that can capture and send data to a processor and can operate with visible and invisible light (example is infrared).

An integrated display 1460 with a body 1470 and display screen 1480 showing the target 1481 and reticles 1482 and 1483 is provided. The display 1460 operates similar to the single camera integrated display described above.

Thus, it is apparent that there has been provided, in accordance with the invention, a sight system supporting multiple lasers that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A device for use with an object that can project a projectile initially on a projectile axis, said device comprising:

a first clamp holding a first optical component, said first optical component having a first optical component optical axis; and a second clamp holding a second optical component, said second optical component having a second optical component optical axis, wherein said first optical component and said second optical component are offset equidistant from the projectile axis, wherein said first optical component optical axis, said second optical component optical axis and said projectile axis lie in a plane, and wherein said first optical component and said second optical component simultaneously are used to bracket a point upon a target that said projectile axis is aimed.

2. The device of claim 1, wherein said first optical component is a camera.

3. The device of 1, wherein:

said first optical component is a first laser selectably projecting a first laser beam;

said second optical component is a second laser selectably projecting a second laser beam; and said first laser beam and said second laser beam bracket said projectile axis as said first laser beam and said second laser beam are simultaneously projected onto the target, said projectile axis being centered between said first laser beam and said second laser beam.

4. The device of claim 3, wherein said first laser beam is divergent from said second laser beam, whereby said first laser beam and said second laser beam do not converge with said projectile axis.

5. A device for use with an item that can project a projectile initially along a projectile axis towards a target, said device comprising:

a first clamp for supporting a first laser that can project a first laser beam along a first laser beam axis;

a second clamp for supporting a second laser that can project a second laser beam along a second laser beam axis, said first clamp and said second clamp being secured to the item on opposite sides of the projectile axis, wherein the first laser beam and the second laser beam are simultaneously projected onto the target to form a bracket on the target indicating a location on the target where the projectile axis is aimed, the location being centered within the bracket, wherein the projectile axis, the first laser beam axis and the second laser beam axis lie in a single plane.

6. The device of claim 5 wherein said first clamp and said second clamp are connected to each other with at least two bolts.

7. The device of claim 5, wherein said first laser beam is divergent from said second laser beam, whereby said first laser beam and said second laser beam do not converge with said projectile axis, wherein said bracket has a bracket spread that increases in proportion with distance from the target.

8. A device for use with an object that can project a projectile initially on a projectile axis, said device having:

a structure supporting a first laser and a second laser, said first laser selectably projecting a first laser beam along a first laser beam axis, said second laser selectably projecting a second laser beam along a second laser beam axis, wherein said first laser beam axis, said second laser beam axis and the projectile axis lie in a plane, said projectile axis is centered between said first laser beam axis and said second laser beam axis, yet said first laser beam axis is divergent from said second laser beam axis whereby said first laser beam and said second laser beam do not converge with said projectile axis, wherein said first laser beam and said second laser beam are simultaneously projected onto a target to form a bracket on the target indicating a location on the target where the projectile axis is aimed, and wherein said bracket has a spread that increases in proportion with a distance between said structure and the target.

9. The device of claim 8, wherein said structure comprises a first clamp for said first laser and a second clamp for said second laser.

* * * * *